US007355575B1

(12) United States Patent
Ota et al.

(10) Patent No.: US 7,355,575 B1
(45) Date of Patent: Apr. 8, 2008

(54) MATRIX PANEL DISPLAY APPARATUS AND DRIVING METHOD THEREFOR WHEREIN AUXILIARY SIGNALS ARE APPLIED TO NON-SELECTED PICTURE ELEMENTS

(75) Inventors: Masayuki Ota, Katsuta (JP); Makoto Tsumura, Hitachi (JP); Masaaki Kitajima, Hitachi Ota (JP); Yasuyuki Mishima, Hitachi (JP); Naofumi Kakehi, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 08/816,891

(22) Filed: Mar. 13, 1997

Related U.S. Application Data

(62) Division of application No. 08/139,904, filed on Oct. 22, 1993, now abandoned.

(30) Foreign Application Priority Data

Oct. 29, 1992 (JP) ..... 4-291125
Mar. 10, 1993 (JP) ..... 5-048981

(51) Int. Cl.
*G09G 3/36* (2006.01)

(52) U.S. Cl. ..... 345/87; 345/92; 345/94; 345/96; 345/99; 345/100

(58) Field of Classification Search ..... 345/87, 345/92, 94, 96, 97, 99, 100; 359/54, 56, 359/59; 349/33, 34, 41, 42
See application file for complete search history.

(56) References Cited

U.S. PATENT DOCUMENTS 5,151,805 A * 9/1992 Takeda et al. ..... 345/94
(Continued)

FOREIGN PATENT DOCUMENTS

JP 2-913 * 1/1990
(Continued)

OTHER PUBLICATIONS

Society for Information Display International Syposium Digest of Technical Papers, vol. XX, pp. 242-245, 1989.*
(Continued)

*Primary Examiner*—Richard Hjerpe
*Assistant Examiner*—Leonid Shapiro
(74) *Attorney, Agent, or Firm*—Antonelli, Terry, Stout & Kraus, LLP.

(57) ABSTRACT

A matrix panel display apparatus includes plural signal lines and plural scanning lines intersecting each other and, near each intersection point, a picture element including a picture element electrode, a counter electrode, a display medium disposed between the picture element electrode and the counter electrode, and a transistor for applying image signals from the signal line to the picture element electrode. The transistor is controlled in response to scanning signals received on a scanning line. An auxiliary signal generating circuit generates auxiliary signals for increasing effective voltages of the image signals and applies the auxiliary signals to the picture elements while each of the transistors is in a non-conducting state and each of the picture elements is not selected. Preferably, the auxiliary signal generating circuit applies the auxiliary signals to the picture elements during a predetermined period in which all of the transistors are in the non-conducting state and none of the picture elements is selected.

16 Claims, 23 Drawing Sheets

U.S. PATENT DOCUMENTS

| | | | | | |
|---|---|---|---|---|---|
| 5,253,091 | A | * | 10/1993 | Kimura et al. | 345/94 |
| 5,283,564 | A | * | 2/1994 | Katakura et al. | 345/87 |
| 5,300,945 | A | * | 4/1994 | Iemoto et al. | 345/92 |
| 5,657,039 | A | * | 8/1997 | Mizukata et al. | 345/95 |
| 5,666,133 | A | * | 9/1997 | Matsuo et al. | 345/100 |
| 5,706,023 | A | | 1/1998 | Nagata et al. | |

FOREIGN PATENT DOCUMENTS

| | | | |
|---|---|---|---|
| JP | 4-145490 | | 5/1992 |
| JP | 145490 | * | 5/1992 |

OTHER PUBLICATIONS

Society for Information Display International Syposium Digest of Technical Papers, vol. XXIII, pp. 47-50, 1992.*

Society For Information Display International Symposium Digest of Technical Papers, vol. XX p. 242-245. Baltimore Convention Center, Baltimore, Maryland, May 16-18, 1989.

Society For Information Display International Symposium Digest of Technical Papers, vol. XXIII, Hynes Convention Center, Boston, Massachusetts, May 17-22, 1992.

* cited by examiner

EQUIVALENT CIRCUIT OF PICTURE ELEMENT

MATRIX PANEL DISPLAY APPARATUS AND DRIVING METHOD THEREFOR WHEREIN AUXILIARY SIGNALS ARE APPLIED TO NON-SELECTED PICTURE ELEMENTS

This application is a continuation of application Ser. No. 08/139,904 filed Oct. 22, 1993 now abandoned.

BACKGROUND OF THE INVENTION

The present invention relates to a matrix display apparatus and its driving method; particularly, to a display apparatus and a driving method capable of uniform brightness display, as well as the lowering of signal voltages and power consumption.

One of the important considerations in the design and operation of a liquid crystal display apparatus is the lowering of the driving voltage. Lowering the driving voltage brings about improvement of such factors as picture quality deterioration, non-uniform brightness in the display panel and power consumption reduction. Furthermore, the reliability of circuits in the display apparatus can be improved and a lower price can be realized by downsizing the driving circuits. Especially, in using MOS-LSI techniques in the manufacture of the driving circuit, the price of the display apparatus is lowered significantly because the area of a LSI chip can be made small in size. As mentioned above, it is very advantageous to the picture quality, the power consumption and the price to lower the driving voltage of a liquid crystal display.

Various methods for lowering the driving voltages have been presented. One of them is described in "SOCIETY FOR INFORMATION DISPLAY INTERNATIONAL SYMPOSIUM DIGEST OF TECHNICAL PAPERS, (1989), pp 242-244". The method described in this paper changes the scanning voltage and the counter electrode voltage pulse-wise, in-phase and by the same amplitude, adjusting to the scanning timing for lowering the signal voltage (source voltage) of the voltages driving a TFT (Thin Film Transistor) liquid crystal matrix panel. By this method, the amplitudes of signal voltages can be lowered, but the waveform distortion of the counter electrode voltages and the scanning voltage increases, since parasitic capacitances and resistances of the wiring increase due to an increase in the size of the liquid crystal panel. Therefore, the voltage applied to the liquid crystal changes depending on the pattern displayed on the panel, and a non-uniform brightness and a deterioration of picture quality occurs in the panel thereby. Especially, in a high resolution liquid crystal panel having about a thousand scanning lines, the influences of the waveform distortion becomes severe and the picture quality deterioration occurs significantly due to a short scanning time of one line. Another method for lowering the signal voltage is also described in "SOCIETY FOR INFORMATION DISPLAY INTERNATIONAL SYMPOSIUM DIGEST OF TECHNICAL PAPERS, (1992), pp 47-50". Although it is possible with this method to reduce the deterioration of the picture quality due to the waveform distortion of the scanning voltages and the counter electrode voltages and to lower the driving voltage, direct current voltages are superposed on the voltages applied to the liquid crystal unless the parasitic capacitances between TFT terminals and the storage capacitances are uniform over the panel. Thereby, the phenomena of elongation of a display renewing time, namely, an after-image occurs. The reliability of the liquid crystal decreases by the superposition of the direct current voltage on the liquid crystal. The storage capacitances and the parasitic capacitances have considerable non-uniformity in the panel when the panel size is as much as 10-15 inches, which is as large as the display panel size of personal computers. The non-uniformity is induced because the accuracy of photo-mask adjustment and etching in the process of TFT production degrades proportionately as the panel size becomes large. So the reliability deterioration of the liquid crystal and the of the after-image phenomenon occurrence become more significant as the panel size increases. Other methods for decreasing the signal voltage are presented in Japan Laid Open 913/1990 and Japan Laid Open 145490/1992. These methods do not resolve the problem of poor picture quality, such as the occurrence of a striped picture in the horizontal direction (referred to as smearing).

SUMMARY OF THE INVENTION

Objectives of the present invention are providing a display apparatus and a drive method in which the signal voltages of the liquid crystal matrix panel are lowered without deteriorating the picture quality, non-uniformity of brightness over the panel caused by non-uniformity of output voltages of the drive circuit and the parasitic capacitances between terminals of TFTs is reduced and smearing in a displayed picture is prevented.

In order to attain the above mentioned objectives, the present invention presents a matrix panel display apparatus having plural signal lines and plural scanning lines intersecting with each other and, near each intersection point, a picture element, including a picture element electrode, a counter electrode, a display medium between the two electrodes and a transistor for applying image signals from the signal line to the picture element electrode being controlled, based on the scanning signals from the scanning line, which apparatus comprises:

means for generating auxiliary signals for increasing the effective voltages of the image signals and for applying the auxiliary signals to the picture elements, while each transistor is non-conducting and each of the picture elements is not selected.

The present invention also presents a matrix panel display apparatus having plural signal lines and plural scanning lines intersecting each other and, near each intersection point, a picture element, including a picture element electrode, a counter electrode, a display medium between the two electrodes and a transistor for applying image signals from the signal line to the picture element electrode being controlled, based on said scanning signals from said scanning line, which the apparatus comprises:

picture signal generating means in a signal circuit for dividing plural picture elements selected at the same time into two groups and for applying a first picture signal group to the first group of picture elements and a second picture signal group, having a polarity reverse to the first picture signal group, to said second group of picture elements; and bias signal generating means for applying first bias signals having a polarity reverse to the first picture signal group to the first group of picture elements through storage capacitances in the first group of picture element, and second bias signals, having a polarity reverse to the second picture signal group, to the second group of picture elements through storage capacitances in the second group of picture elements during a selection period of the first and second groups of picture elements.

A liquid crystal is used as the display medium in the optimal embodiment.

DETAILED DESCRIPTION OF THE EMBODIMENTS

Hereinafter, details of the present invention is explained based on embodiments referring to drawings.

Embodiment 1

Figure 1:
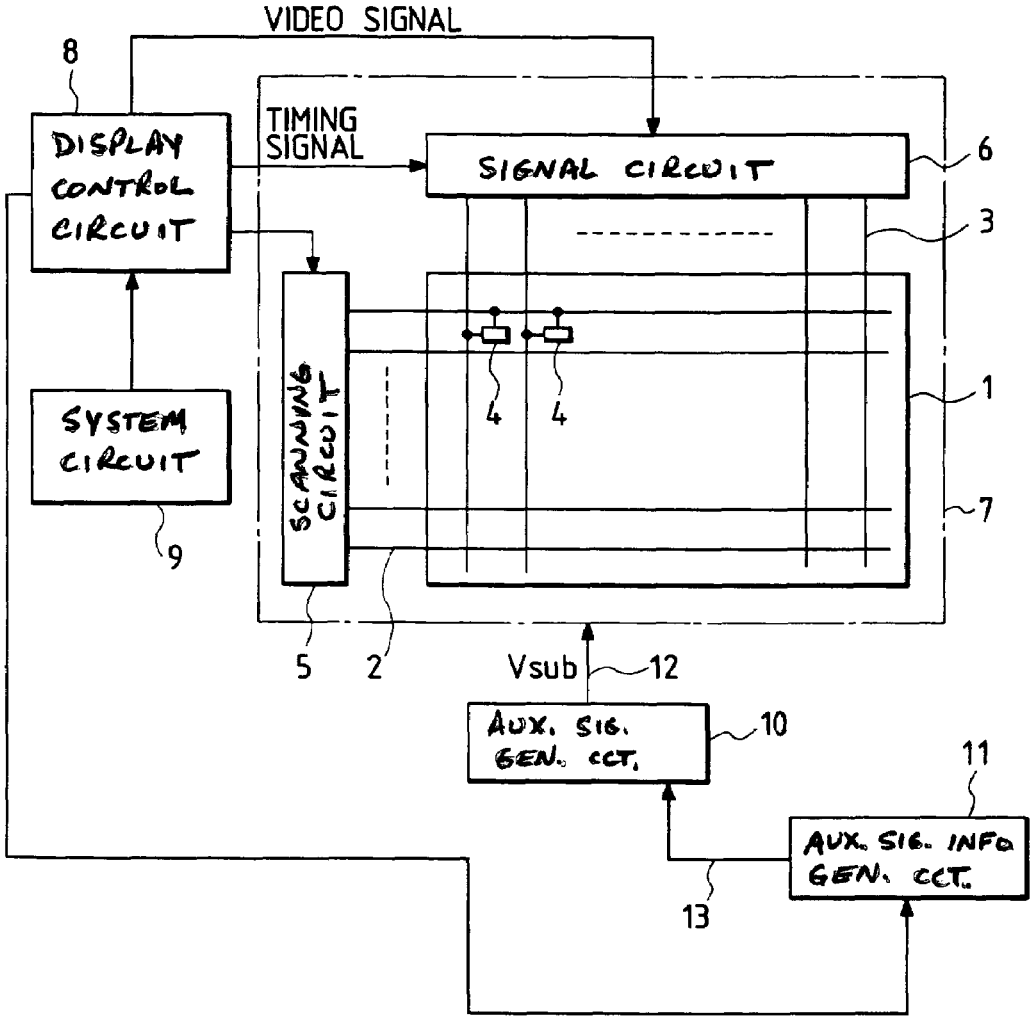
FIG. 1 shows a conceptual diagram of the overall matrix display apparatus of the present invention.

A conceptual figure of the overall constitution of the display apparatus of the present invention is shown in FIG. 1. The display apparatus comprises a matrix panel 1 consisting of scanning lines 2, signal lines 3 and picture elements 4, provided at the intersection points where the lines 2 and the lines 3 cross each other; a scanning circuit 5 and a signal circuit 6 for generating predetermined voltages and applying them to the scanning lines 2 and the signal lines 3, respectively; a display control circuit 8 for supplying timing signals to the scanning circuit 5 and the signal circuit 6 and an auxiliary signal for increasing the effective value of the signal voltages generating circuit 10; a system circuit 9 connected to the display control circuit 8; the auxiliary signal generating circuit 10; and an auxiliary signal information generating circuit 11 connected to the auxiliary signal generating circuit 10 through an auxiliary signal line 13. As to the picture elements 4, any combination of switching elements using such display material as a liquid crystal, electroluminescence and so on is applicable, and so the invention is not restricted to any specific material combinations. And, the brightness or the gradation number of the picture elements is not restricted to any specific value. The auxiliary signal Vsub is inputted into a display part 7 consisting of the scanning circuit 5, the signal circuit 6 and the matrix panel 1 through an auxiliary signal inputting line 12. Examples of Vsub are described later. As shown in FIG. 1, the present invention is characterized by the method of selecting each picture element in turn by the scanning circuit 5, applying the picture signal voltage to the selected picture element by the signal circuit 6 (a first driving means), applying the auxiliary signal Vsub obtained by the auxiliary signal generating circuit 10 (a second driving means) to each picture element in the display part and displaying any pictures on the matrix panel 1 by driving the matrix panel 1 with the synthesized signals of signals generated by the first and second driving means. The auxiliary signal information generating means 11 generates the information for determining the waveform of the auxiliary signal based on the environmental conditions, such as temperature, the display picture quality conditions, such as the brightness or the contrast of the picture elements, and so forth, and inputs the information into the auxiliary signal generating circuit 10. The information from the system circuit 9 may be directly inputted into the auxiliary signal generating circuit 10.

Figure 2A:
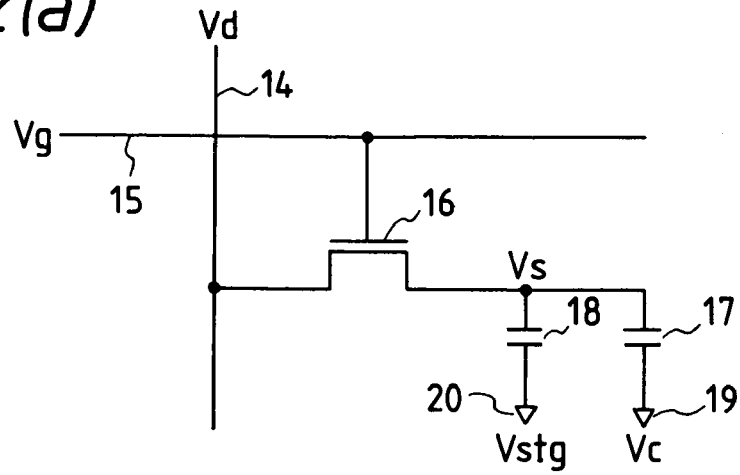
FIGS. 2(*a*) and 2(*b*) show equivalent circuits the picture elements in the matrix display apparatus.
Figure 2B:
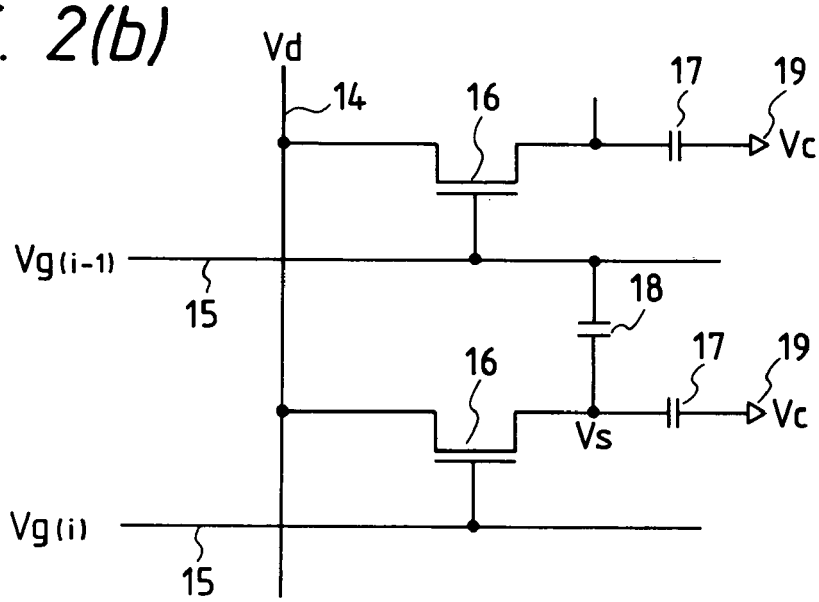
Figure 4:
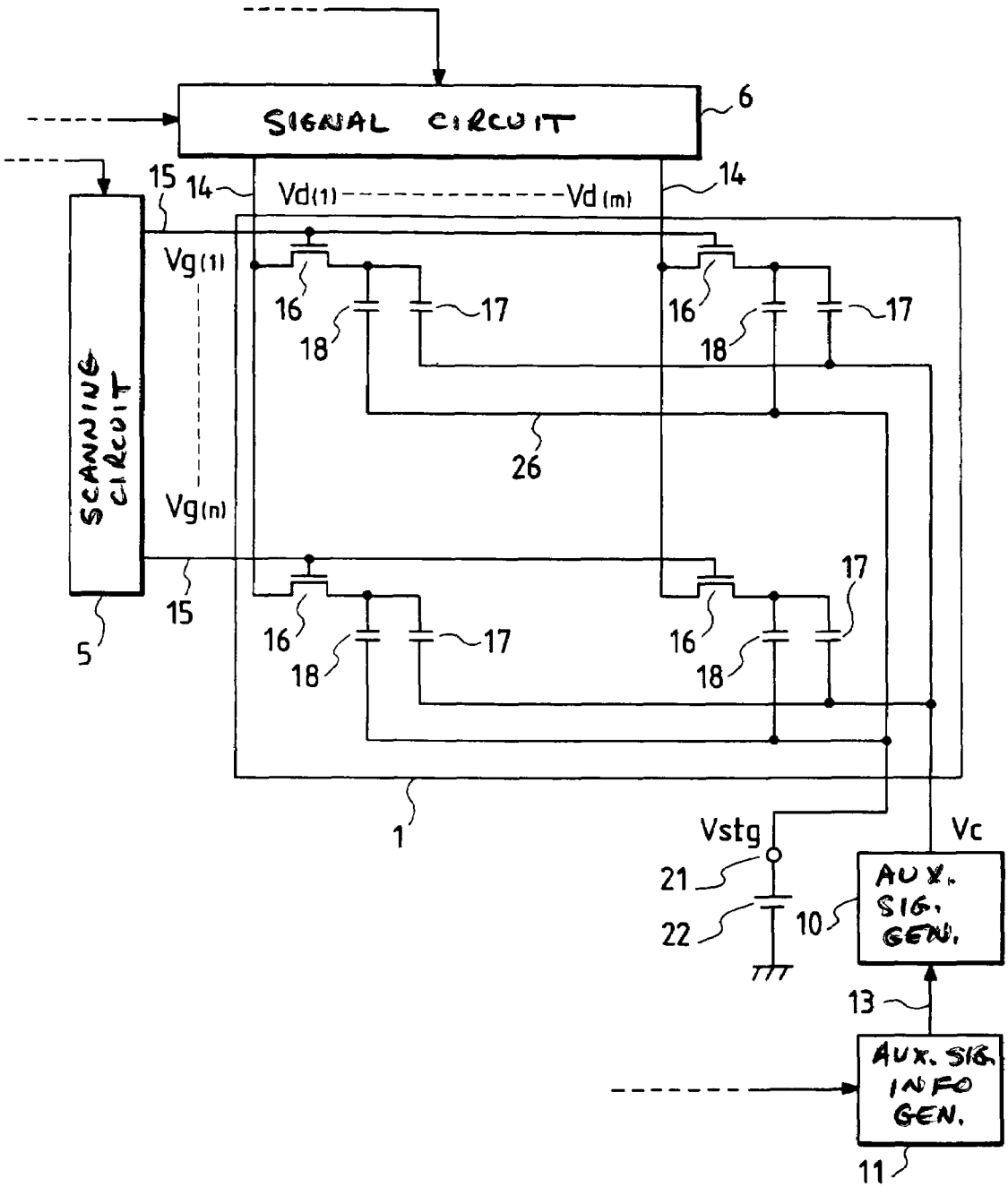
FIG. 4 shows a first embodiment of the liquid crystal matrix display panel.

An embodiment of the present invention will be explained by taking a liquid crystal display apparatus as an example. Equivalent circuit examples of the picture elements 4 in the liquid crystal display apparatus are shown in FIGS. 2(*a*) and 2(*b*). The liquid crystal 17 is driven by a switching element 16, such as a TFT. A MOS transistor, or a bipolar transistor besides a TFT, is also applicable for use in the switching element. The storage capacitances 18 connected in parallel with the liquid crystal 17 are not necessarily needed, but providing such storage capacitances is convenient to constituting a flexible display apparatus. The difference between the equivalent circuit of FIG. 2(*a*) and that of FIG. 2(*b*) is that a terminal of the storage capacitance 18 is connected to a storage capacitance voltage inputting terminal 20 in FIG. 2(*a*) and to the scanning line 15 in FIG. 2(*b*). FIG. 4 shows an embodiment of the present invention in which the equivalent circuit of the picture elements 4 is that of FIG. 2(*a*). One picture element consists of the TFT 16, the liquid crystal 17 and the storage capacitance 18, and all of the picture elements are arranged as distributed dots of a (m×n) matrix. A terminal of each liquid crystal 17 is connected to a respective TFT 16 and the other terminal of the liquid crystal 17 is connected to the auxiliary signal generating circuit 10. A terminal of each storage capacitance 18 is connected to a respective TFT 16 and the other terminal of the storage capacitance 18 is connected to the storage capacitance voltage inputting terminal 21. A power source 22 is connected to the storage capacitance voltage inputting terminal 21. The above-mentioned liquid crystal display matrix panel ordinarily consists of plural signal lines and plural scanning lines wired on a substrate made of a material such as glass and which cross each other, picture element electrodes provided near each point of intersection, a first substrate on which the TFTs connected to the signal lines and the scanning lines are wired, a second substrate confronting the first substrate and having counter electrodes at places opposite to the picture element electrodes on the second substrate, made of such material as glass, the liquid crystal existing between the picture element electrodes and the counter electrodes. The counter electrodes are other side terminals of the liquid crystals 17 and are connected to the auxiliary signal generating circuit 10.

Figure 3:
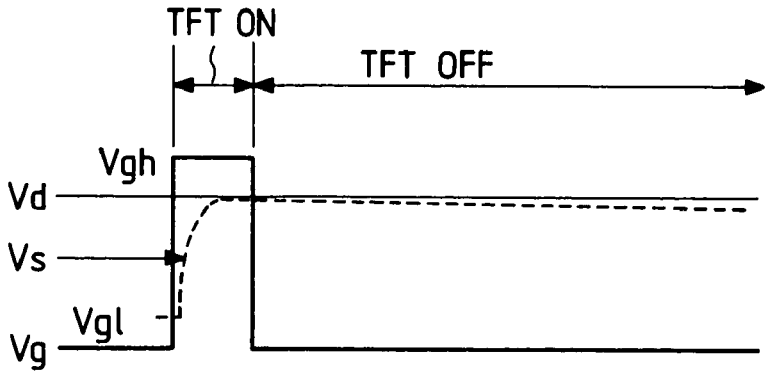
FIG. 3 shows a waveform of the operations of the picture element in the matrix display apparatus.

The operation of the picture element will be explained with reference to FIG. 2(*a*) and FIG. 3. When the scanning voltage Vg (Vgh, Vg1) rises to the high voltage Vgh, the TFT switches to the ON state and the image signal voltage Vd applied to the signal line 14 is written into the liquid crystal 17. The picture element voltage Vs consequently becomes equal to the image signal voltage Vd. And, when the scanning voltage Vg drops to the low voltage Vgl, the TFT switches to the Off state, but the state of the voltage Vs scarcely changes (holding state), but is maintained for a time by the effects of the electrostatic capacitance of the liquid crystal and the storage capacitance. As mentioned above, the liquid crystal is driven by the ON or OFF operations of the TFT. The brightness of the liquid crystal is controlled by changing the voltage level of the image signal voltage Vd during the time the TFT stays in the ON state. The brightness of the liquid crystal 17 also depends on the voltage Vlc applied to the liquid crystal, namely, the voltage difference (Vlc=Vs−Vc) between the picture element voltage Vs and the common voltage Vc applied to the common terminal 19, which is the terminal of the opposite side of the liquid crystal. Therefore, the brightness of the liquid crystal 17 can be controlled by the picture element voltage Vs or the common voltage Vc, and full color display is also possible by controlling each voltage Vlc corresponding to each color of R(red), G(green) and B(blue). The constitution of the panel is not restricted to one having two opposite substrates as described in the embodiment 1.

Embodiment 2

Figure 5:
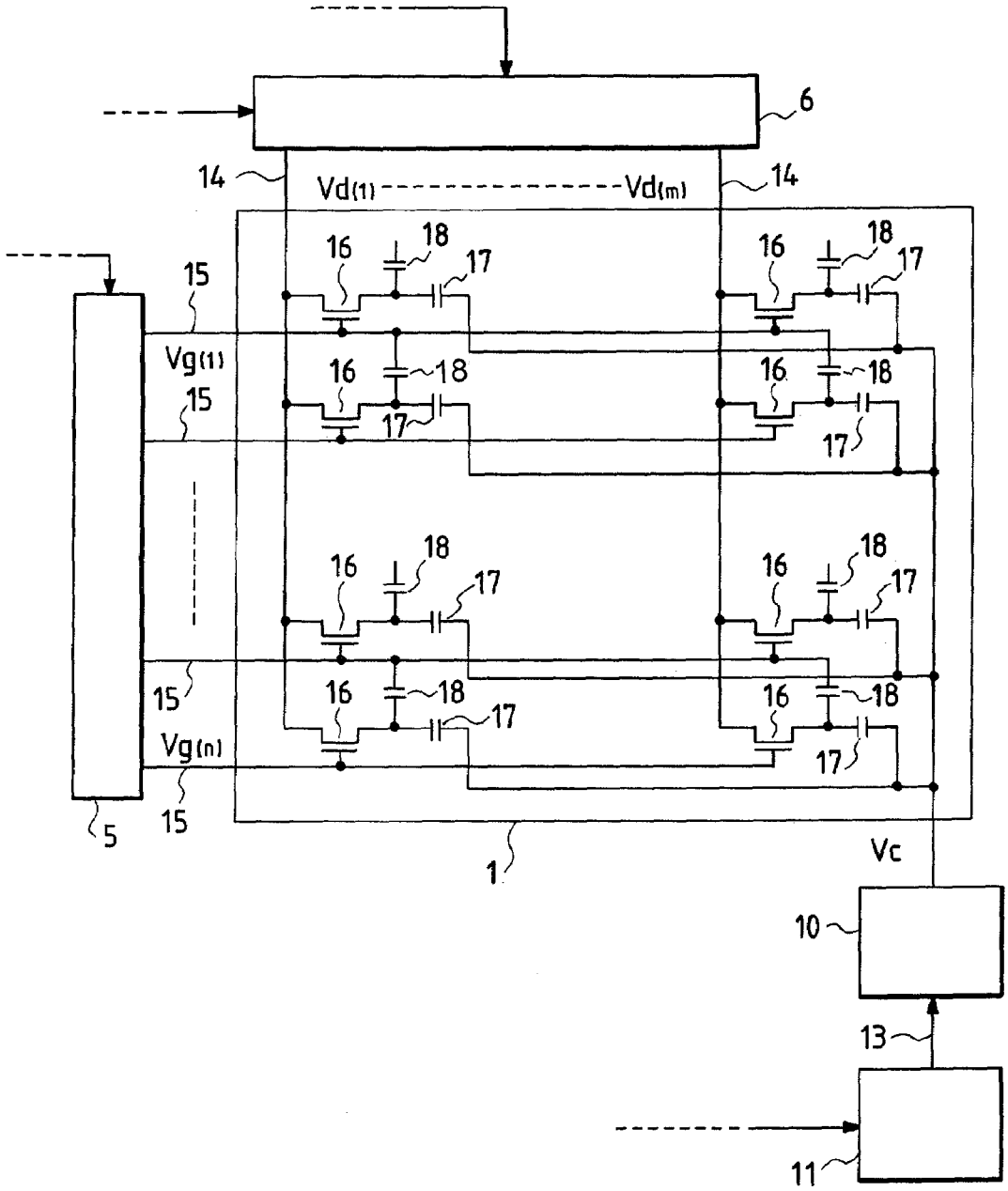
FIG. 5 shows a second embodiment of the liquid crystal matrix display panel.
Figure 6:
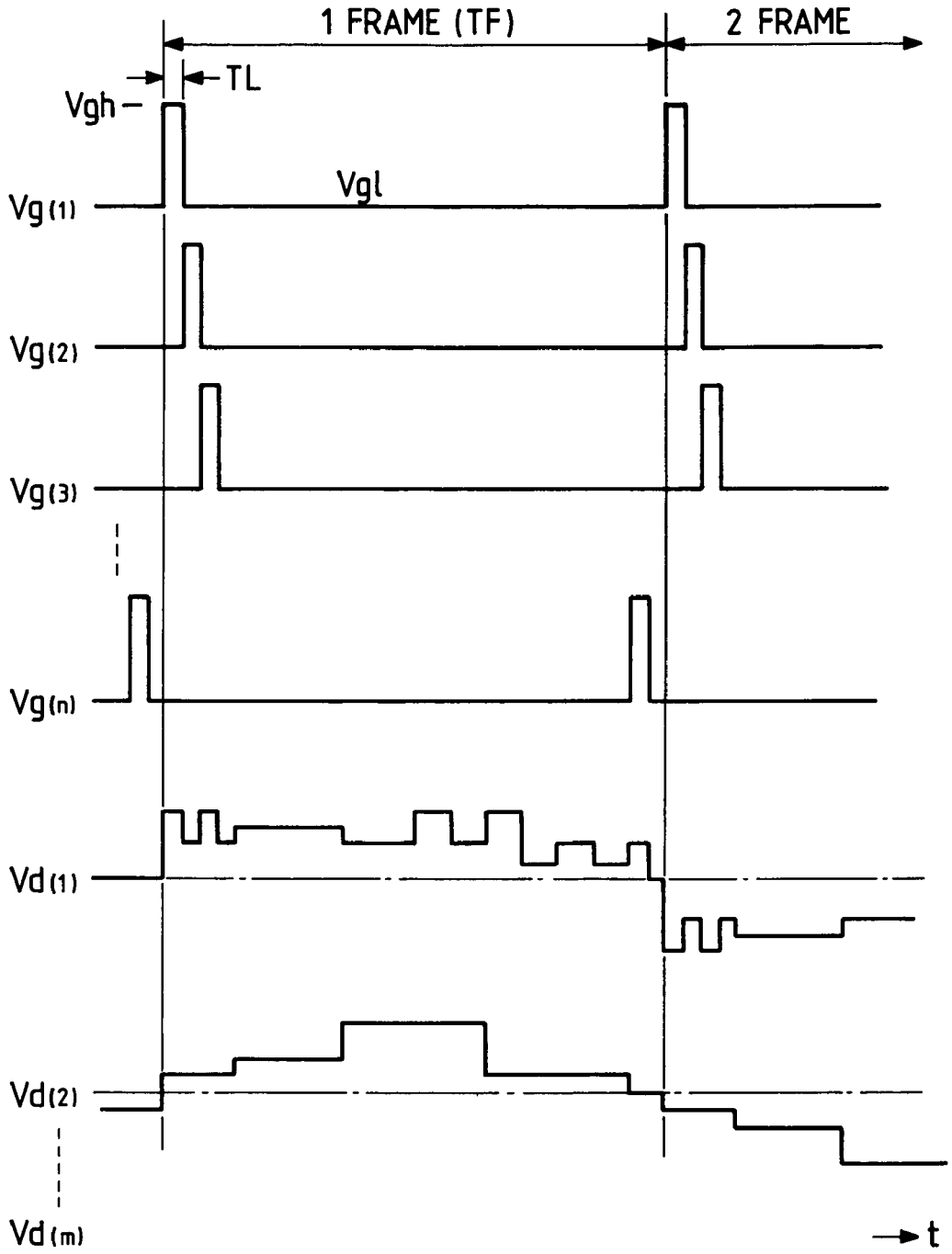
FIG. 6 shows waveform of the driving timing of the liquid crystal matrix display panel.
Figure 7:
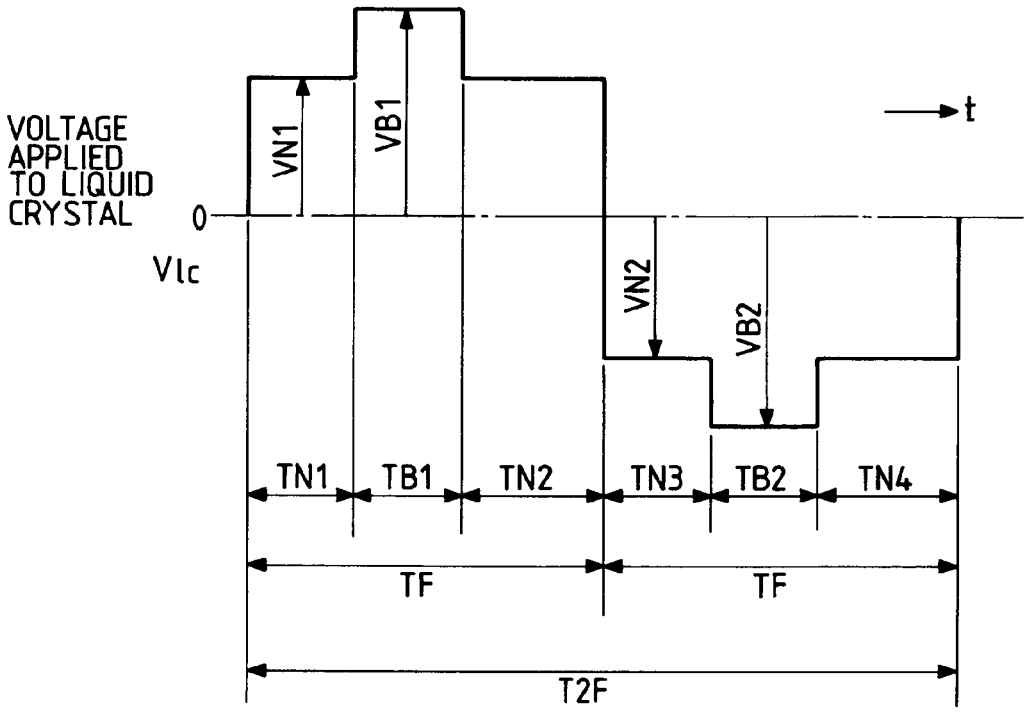
FIG. 7 shows the fundamental waveform of the voltage applied to the picture element in the present invention.
Figure 8:
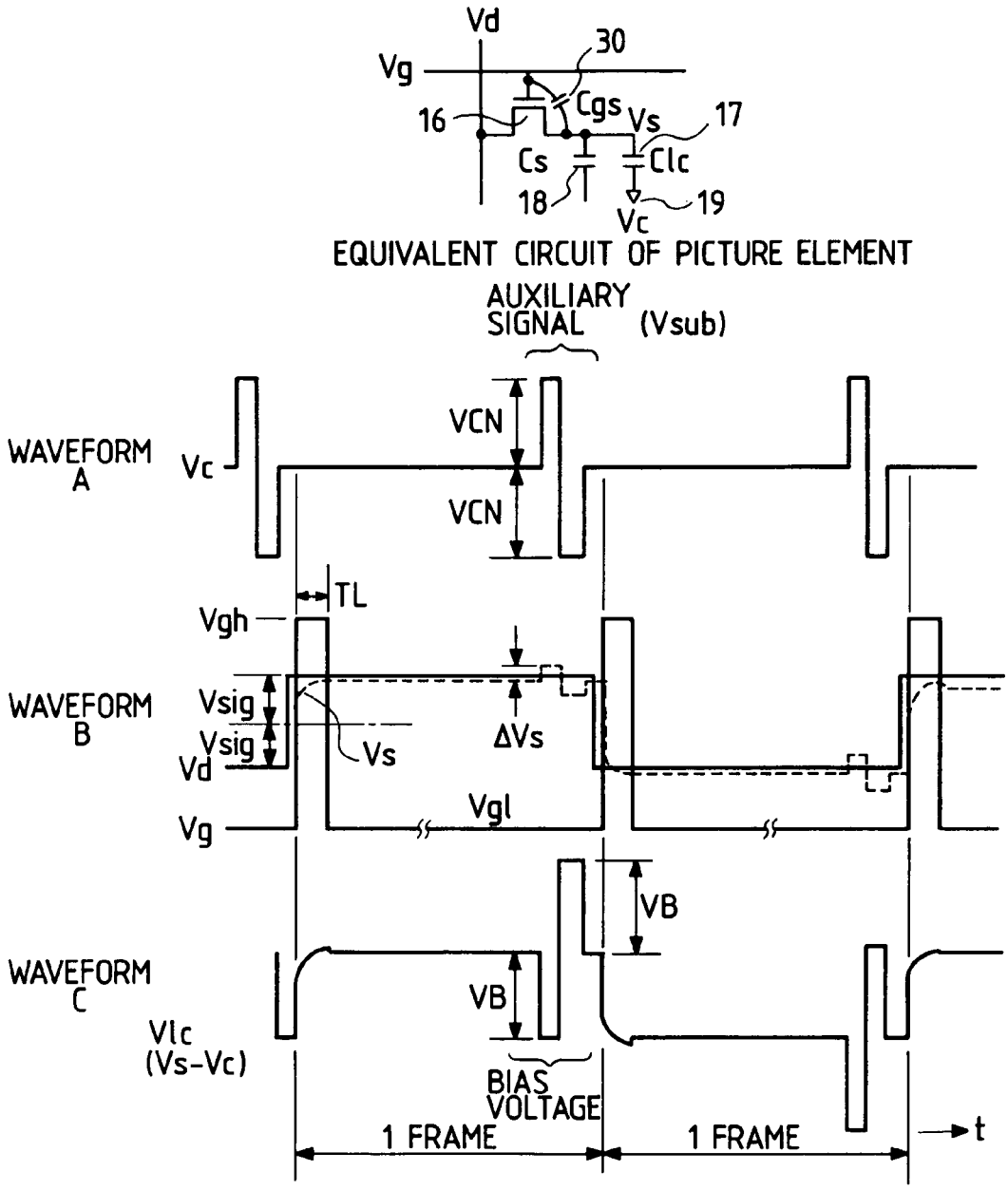
FIG. 8(*a*) is a schematic diagram of an equivalent circuit of a picture element and FIGS. 8(*b*)-8(*d*) are waveform diagrams of the driving timing in the present invention.

FIG. 5 shows an embodiment of the present invention in which the equivalent circuit of the picture elements 4 is that of FIG. 2(*b*). One picture element consists of the TFT 16, the liquid crystal 17 between a picture element electrode and a counter electrode (not shown in the figure) and the storage capacitance 18, and all of the picture elements are arranged as distributed dots of a (m×n) matrix. A terminal of each liquid crystal 17 is connected to a respective TFT 16 and the other terminal of the liquid crystal 17 is connected to the auxiliary signal generating circuit 10. A terminal of each storage capacitance 18 is connected to a respective TFT 16 and the other terminal of the storage capacitance 18 is connected to a scanning line 15, which defers from the embodiment 1. FIG. 7 shows an example of driving timing for the scanning electrodes and the signal electrodes of the liquid crystal matrix panel, which is common to the embodiments 1 and 2. The scanning voltage Vgl-Vgn are applied in turn to n scanning lines 15 for setting the TFTs to the ON state so that the voltage Vgh will be applied to the TFTs in succession for time TL. The TFTs turn to the OFF state for the time (TF-TL) when the scanning voltage is Vgl. The signal voltages Vd(1)-Vd(m) applied to the scanning lines 14 are changed in accordance with the scanning timing, and a method for applying the signal voltages is not restricted to any specific method. By the above mentioned driving method, each signal voltage is written to a liquid crystal 17 and pictures are displayed. FIG. 7 shows the fundamental waveform of the voltage Vlc applied to the liquid crystal 17 in the driving apparatus of the present invention. As mentioned above, the voltage Vlc is the difference between the output voltage Vs of a TFT 16 and the common voltage Vc, and the brightness of the liquid crystal 17 depends on the strength of Vlc, that is, the effective voltage during one period of T2F. The voltage Vlc applied to the liquid crystal 17 consists of the voltage components VN1, VN2 outputted by the first voltage applying means, namely, the signal circuit 6, and the voltage components VB1, VB2 outputted by the second voltage applying means, namely, the auxiliary signal generating circuit 10. The voltages generated by the first voltage applying means drive the liquid crystal for the periods TN1, TN2, TN3 and TN4, and the voltages generated by the second voltage applying means drive the liquid crystal for the periods TB1 and TB2. The voltage components VB1, VB2 outputted by the second voltage applying means are applied for the period when all TFTs in the effective picture elements of the matrix panel are in the OFF state. The voltages VN1, VN2 generated by the first voltage applying means shown in FIG. 7 change depending on the signal voltage Vd made by video signals. The length of each period of TN1, TN2, TN3 and TN4 when the voltages VN1, VN2 are applied to the liquid crystal is not restricted to any specific value. The waveform of the voltage made by the second voltage applying means is not restricted to any specific shape. That is, the periods TB1, TB2 and the heights of VB1, VB2 are discretional, and the polarity of the pulse voltages applied to the liquid crystal is not restricted to either mono-polarity or bipolarity. And, applied frequency of the driving voltage produced by the second voltage applying means is also discretional. Further, the voltages produced by the first voltage applying means are shown as constant in FIG. 7 for the periods TN1, TN2, TN3 and TN4, but these voltages may change with time without detracting from the utility of the present invention. The voltage waveform of the picture element by the above-mentioned driving method is explained by using FIGS. 8(*a*)-8(*d*). In FIG. 8(*a*), the equivalent circuit of the picture element and in FIGS. 8(*b*)-8(*d*) the waveforms of each part of the circuit are shown. One picture element consists of the TFT 16, the liquid crystal 17, the storage capacitance 18, the common voltage inputting terminal 19 and the capacitance Cgs 30 between a gate and a source of the TFT. Waveform examples of the voltage driving the circuit and each part of the circuit are shown by the waveforms A, B and C in FIGS. 8(*b*)-8(*d*), respectively. The waveform A shows the common voltage Vc and one pulse having the amplitude of ±VCN is generated as an auxiliary signal during one frame. The waveforms B show waveforms of the scanning voltage Vg, the image signal voltage Vd and the source voltage Vs. The waveform C is a waveform of the voltage Vlc which is the difference voltage between the source voltage Vs and the common voltage Vc. As shown in the waveforms B, the source voltage Vs becomes nearly equal to the signal voltage Vd within the period TL when the TFT 16 turns to the ON state. After the period, the TFT turns to the OFF state and the written voltage is held. Strictly speaking, the source voltage Vs slightly decreases by a resistance of the liquid crystal and an OFF current flowing during the OFF state of the TFT. And, the source voltage Vs changes by ±ΔVs as shown when the common voltage Vc changes due to the addition of the auxiliary signal Vsub in the OFF state of the TFT. The change of ΔVs is described by Eq. (1).

$$\Delta Vs = VCN \cdot (Cs+Clc)/(Cgs+Cs+Clc) \quad (1)$$

where VCN is the amplitude of the auxiliary signal, Cgs is the parasitic capacitance, Cs is the storage capacitance and Clc is the liquid crystal capacitance. And, the amplitude of the bias voltage VB is described by Eq. (2)

$$VB = VCN - \Delta Vs \quad (2)$$

Figure 9:
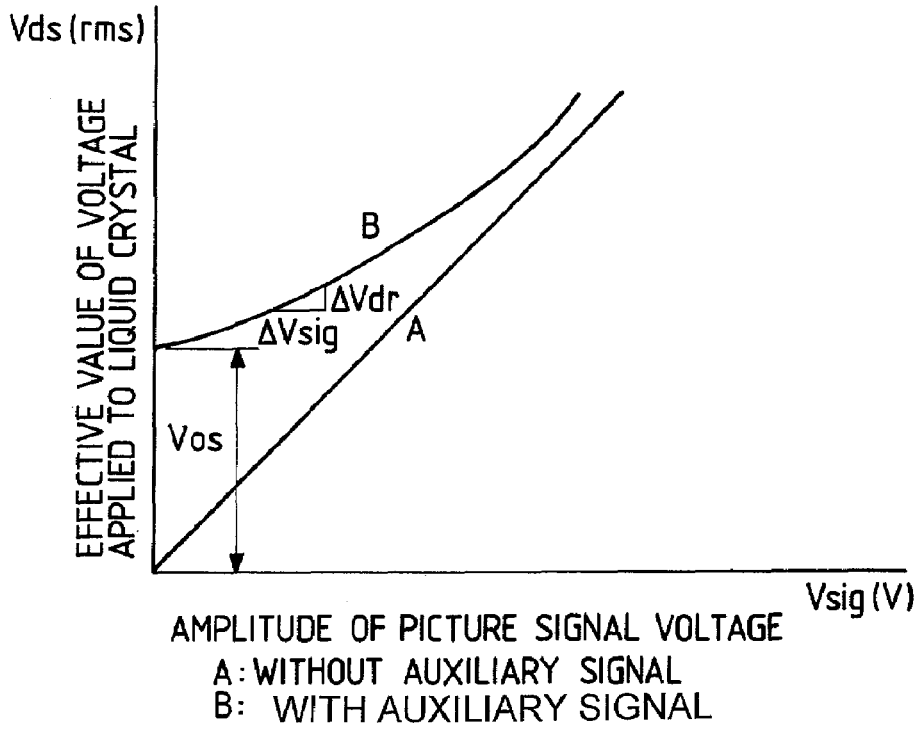
FIG. 9 is a characteristic diagram showing the relation between the effective voltage applied to liquid crystal and the amplitude of a signal voltage (comparing two cases with and without the auxiliary signal).
Figure 10:
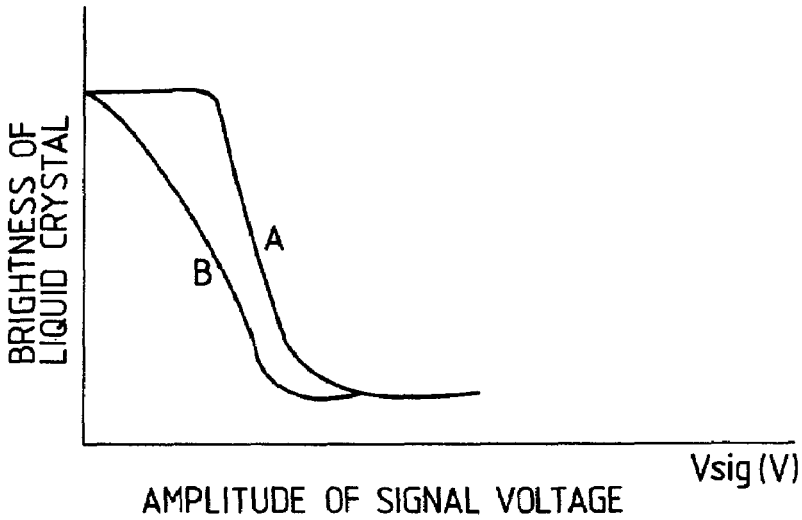
FIG. 10 is a diagram showing the relation between the brightness of a liquid crystal and the amplitude of a signal voltage (comparing two cases with and without the auxiliary signal).

By applying the bias voltage having the amplitude of VB given by Eq. (2), the effective voltage applied to the liquid crystal is higher than the amplitude Vsig given by the image signal voltage Vd without applying the bias voltage. That is, a higher effective voltage than that inputted only by the outer video signals can be obtained. The effective value of the applied voltage to the liquid crystal depends on the amplitude and the width of the auxiliary pulse signal Vsub and the effective voltage becomes higher in accordance with an increase of the amplitude and the width of a pulse. FIG. 9 shows the relation between the image signal voltage amplitude and the effective voltage by comparing two cases with and without the auxiliary signal. Further, FIG. 10 shows the relation between the brightness of the liquid crystal and the image signal voltage amplitude. As shown by the curve B in FIG. 9, Vos is the effective voltage when Vsig equals 0. Although the effective voltage becomes higher in accordance with an increase of the amplitude Vsig, the ratio of the effective voltage deviation to the deviation of the image signal voltage amplitude (=ΔVdr/ΔVsig), namely, the gradient of the curve decreases in accordance with an increase of the effective voltage, as compared with the characteristics of the prior driving method, namely, the driving method without the auxiliary signal applying (the curve A). Therefore, as shown by the curve B in FIG. 10, the ratio of the liquid crystal brightness change to the change of the image signal voltage amplitude becomes smaller, that is, the characteristics of liquid crystal becomes more gentle, as compared with the characteristics of the prior driving method (the curve A). And, the image signal voltage amplitude for obtaining the same brightness of the liquid crystal decreases, as compared with the prior driving method. The brightness and the contrast of a display panel is made considerably more uniform by reducing the brightness variation due to the non-uniformity of the voltage written to a liquid crystal caused by the parasitic capacitance between the terminals of the TFTs and by the variation of the output voltage of the signal circuit. Thereby, it becomes possible to attain a high quality picture display, to downsize the driving circuit, and to lower the power consumption. In Eq. (I), if (Cs+Clc)/(Cgs+Cs+Clc)≦0.5, then ΔVs≦VCN/2, which profitably stabilizes the characteristics of the TFT due to the source voltage fluctuations.

Embodiment 3

Figure 11:
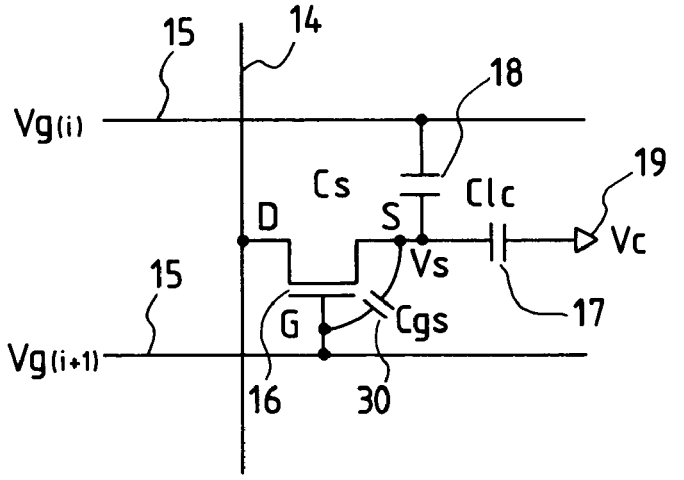
FIG. 11(*a*) is a schematic diagram of an equivalent circuit and FIG. 11(*b*) shows the driving timing in a third embodiment.
Figure 11:
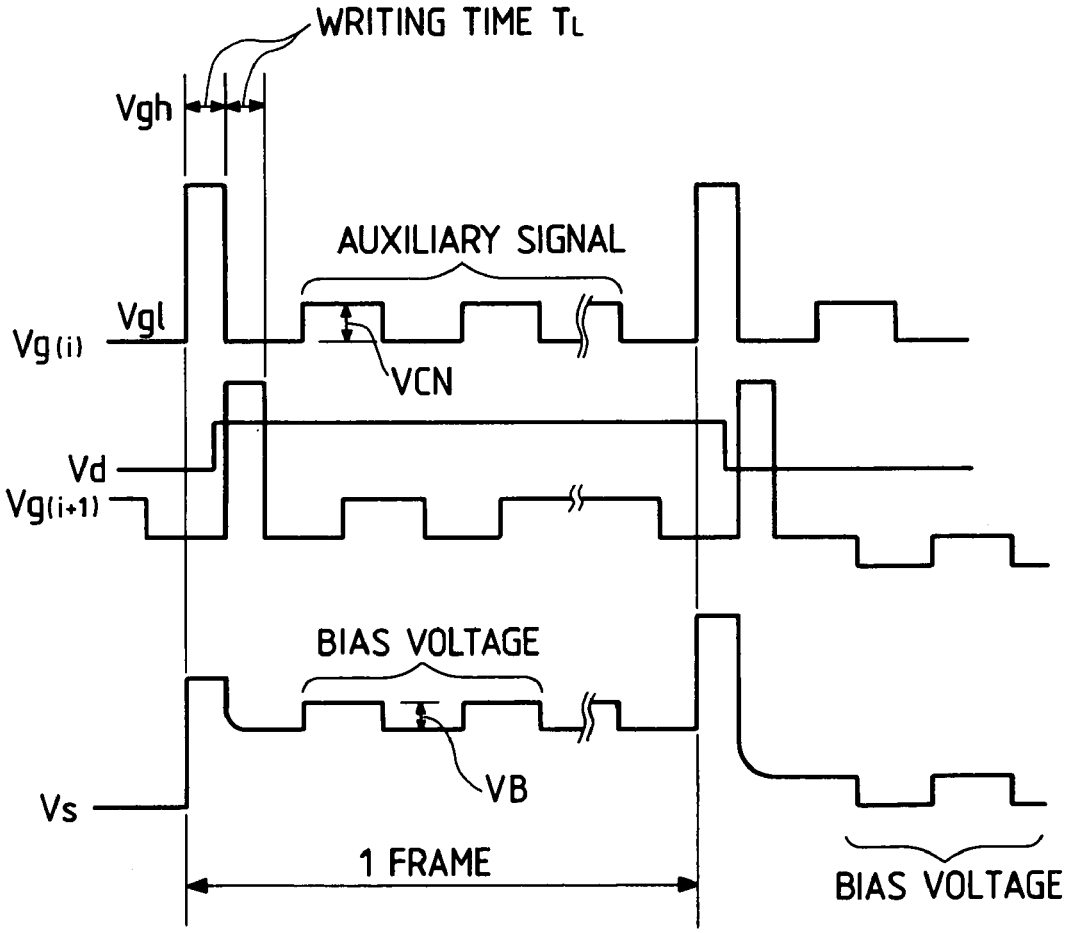

FIG. 11(*a*) shows an equivalent circuit of a picture element and FIG. 11(*b*) is a waveform diagram of the driving timing in another embodiment. The embodiment corresponds to FIG. 2(*b*), in which one terminal of the storage capacitance is connected to the source terminal S and the other terminal is connected to the scanning line 15 adjoining the scanning line connected to the TFT 16. The auxiliary signal Vsub is applied to the common terminal 19 in the embodiment shown in FIG. 5, having the same equivalent circuit shown in FIG. 2(*b*); on the other hand, the auxiliary signal is applied through the scanning line 15 in the present embodiment. The auxiliary signal Vsub of an amplitude VCN smaller than the voltage Vgh besides Vgh,Vgl for turning ON or OFF each TFT is applied to the scanning voltage Vg(i). The voltage Vgh, applied as the scanning voltage Vg(i), is transmitted to the source terminal S of the TFT 16 and, synchronizing it, the source voltage Vs is generated. When the source voltage Vg(i+1) becomes Vgh and the TFT 16 turns to the ON state, the image signal is written to the liquid crystal 17 through the signal line 14 and the source voltage Vs becomes the same voltage as the image signal voltage. Thereafter, the scanning voltage Vg(i+1) decreases to Vgl and the TFT 16 turns to the OFF state, but the written image signal voltage is held. If the auxiliary signal Vsub is applied to the scanning voltage Vg(i) during the period, the auxiliary signal is transmitted to the source terminal S of the TFT 16 through the storage capacitance 18 and the bias signal is applied to the source voltage, synchronizing it with the auxiliary signal Vsub, as shown in the figure. The effective voltage applied to the liquid crystal 17 increases and the same effect as the driving method shown in FIG. 8 is obtained thereby.

Embodiment 4

Figure 12:
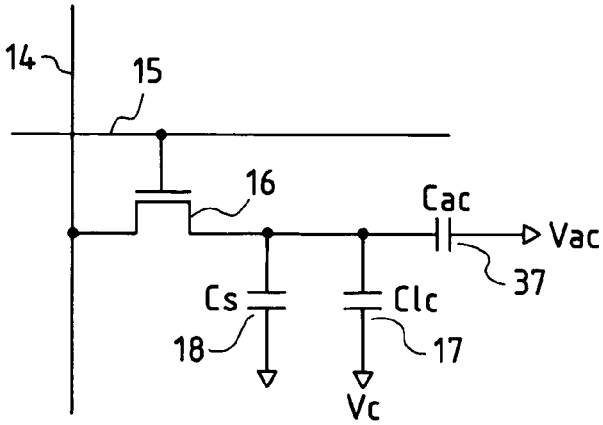
FIG. 12 is a schematic diagram of an equivalent circuit of the display picture element part in a fourth embodiment.

FIG. 12 shows another arrangement of the picture element. The picture element consists of the scanning line 15, the signal line 14, the TTF 16, the storage capacitance 18 and an auxiliary signal transmitting means 37. The auxiliary signal transmitting means 37 may be composed, for example, of a condenser Cac for passing alternating current components and for cutting off direct current components; although the auxiliary signal transmitting means is not restricted to a condenser.

Embodiment 5

Figure 13:
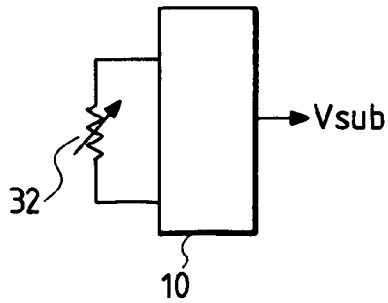
FIG. 13 is a schematic diagram of an example of an auxiliary signal generation means in the fifth embodiment.

FIG. 13 shows an example of the auxiliary signal generating circuit 10 and the auxiliary signal information generating means 11 in FIG. 4 and FIG. 5. In this example, the auxiliary signal information generating means comprises a variable resistance 32. It is preferable that the variable resistance 32 is provided at such places as the outskirts of a display apparatus so as to make is possible to change the resistance easily. Thereby, it is possible to easily change the brightness, contrast and view angle of the displayed picture.

Embodiments effective for resolving mainly such non-uniform display problems as the smearing in the displayed picture are mentioned in the following.

Embodiment 6

Figure 28:
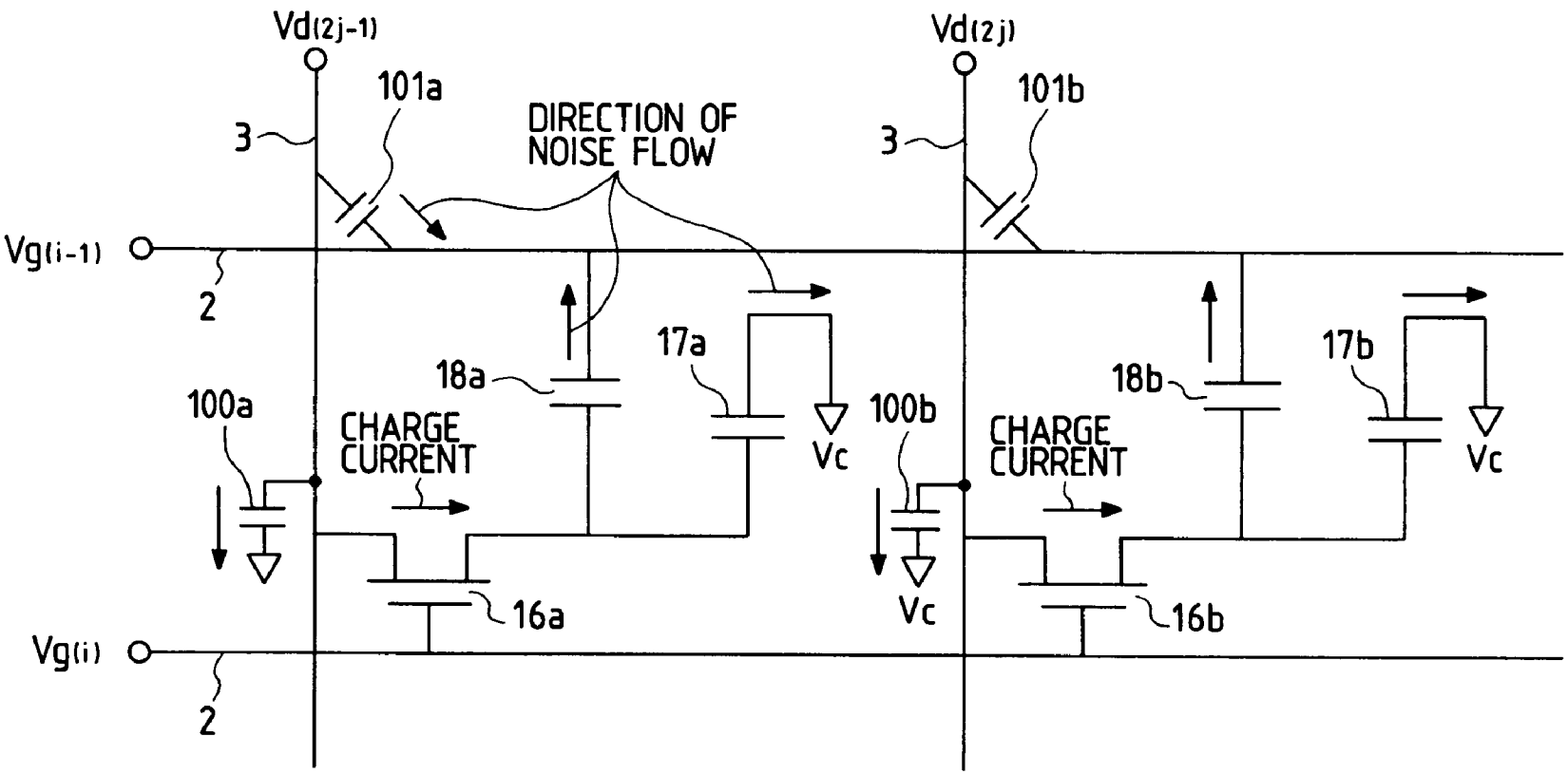
FIG. 28 is a schematic drawing of an equivalent circuit of two adjoining picture elements.

Firstly, the mechanism of the smearing phenomena is briefly explained. The equivalent circuit of two adjoining picture elements spaced in the horizontal direction of the active matrix liquid crystal display apparatus is shown in FIG. 28. The picture element electrodes are connected to the source electrodes of the TFTs 16*a* and 16*b*, and the picture element electrodes, the counter electrodes and the liquid crystal layers between both the electrodes form the liquid crystal capacitances Clc 17*a* and 17*b*. The storage capacitances Cs 18*a* and 18*b* are connected to the source electrodes of TFTs 16*a* and 16*b*. The counter electrode is common to all picture elements and the earth electrode of the storage capacitance is connected to the (i−1)th scanning line 2 (or the storage line 8). Since the counter electrode potential Vc is common through all picture elements and the earth potentials of the storage capacitances (referred to the storage line potential) Vs have the same potential, or so at least at the storage line above one line of the line selected presently, the bias voltages of the same polarity are applied to all the picture elements, at least, above one line. And, to the odd number lines and the even number lines, the same polarity of the signal voltages Vd(2*j*−1) and Vd(2*j*) are applied, respectively. Thereby, the noise effects become significant, since the noises to the storage line potentials Vs and the counter electrode potentials Vc induced by changes of the signal voltages Vd(2*j*−1) and Vd(2*j*) through the capacitances 100*a* and 100*b* between the signal line 3 and the counter electrode and the crossing capacitances 101*a* and 101*b* between the signal line 3 and the storage line 28 have the same polarity in the above-mentioned situations. The time that the changing potentials of Vc and Vs revert to the original potential value depends on the change amplitude of the signal voltage Vd and the load conditions of the line above one line. And, since each picture element at the line above one line is charged by voltages of the same polarity, the directions of inflow and outflow of the charge current ion become the same and the charge currents Ion flow into the counter electrodes and the storage lines whose potentials are returning to a stable state, which prevents the potentials Vs and Vc from reverting to the original value. The voltage written to the picture element is affected by the remaining quantity of the above-mentioned potential variation by the time the TFTs 16*a* and 16*b* turn to the OFF state, which affects the variations of the picture element brightness, since the voltage written to the picture elements are determined by the picture element electrode potentials, the counter electrode potentials Vc and the storage line potential Vs at the time the TFTs 16*a* and 16*b* turn to the OFF state. The variation in the magnitudes of the signal voltages Vd, the load conditions of the lines and the charge currents which determine the remaining quantity of the above-mentioned potential variation at the time the TFTs turn to the OFF state depend on the display picture pattern at the line above one line. Consequently, the poor picture quality, such as the striped picture in the horizontal direction, namely, the smearing, which is a sort of cross talk, is brought about. The embodiment shown hereafter considerably reduces the smearing phenomena by dividing the picture elements selected at the same time into two groups and writing the image signal voltages having a polarity reverse to each other into the first group picture element electrodes and the second group picture element electrodes, respectively, because the potential variations (noises) of the counter electrodes and the storage line (or the scanning line), cancel each other or decrease, and the charge voltages written into the picture elements are well stabilized due to the short time of potential stabilizing.

Figure 14:
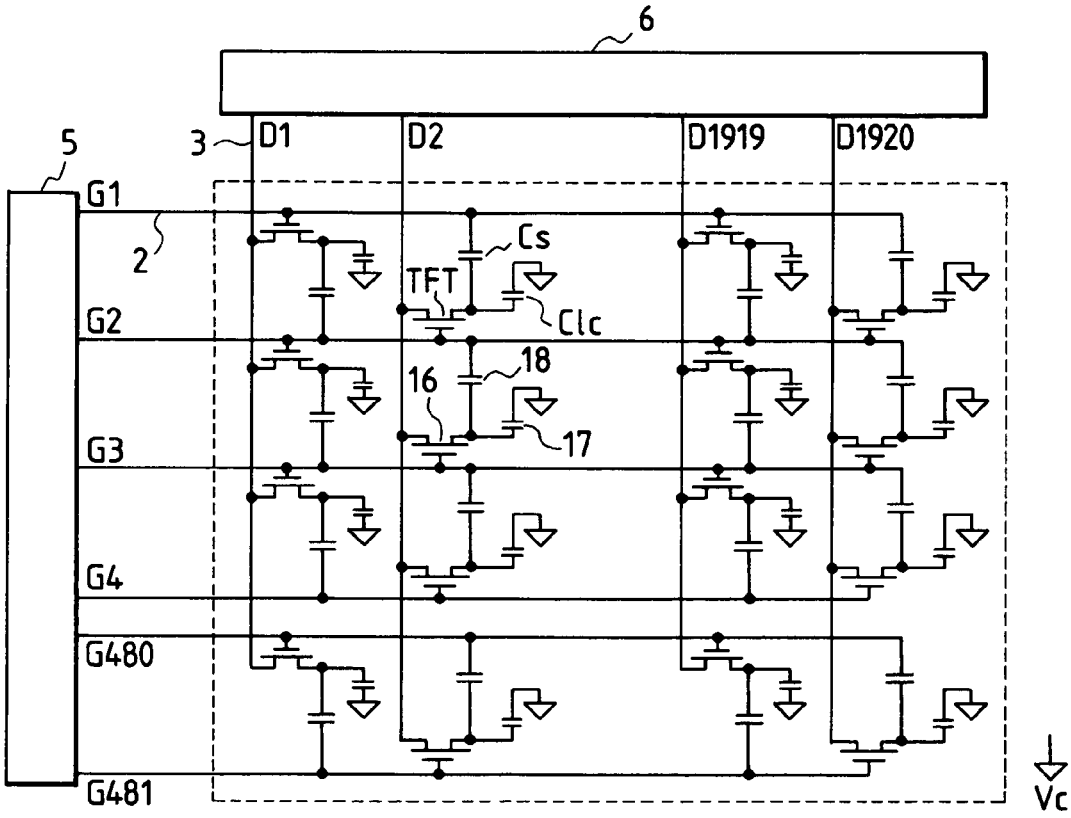
FIG. 14 is a schematic circuit diagram of a sixth embodiment.
Figure 15:
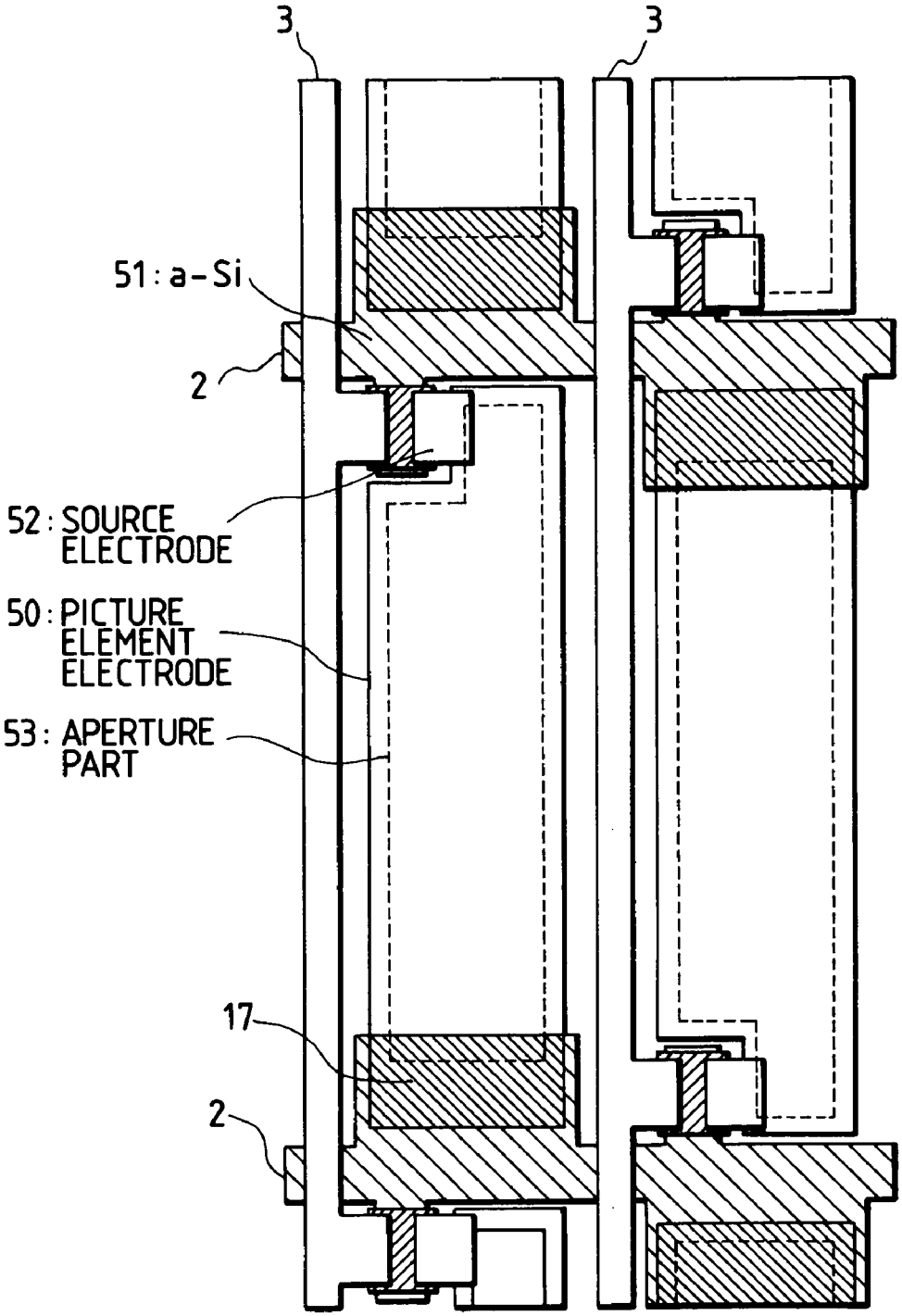
FIG. 15 shows a plane view of the structure of a picture element in the sixth embodiment.
Figure 16:
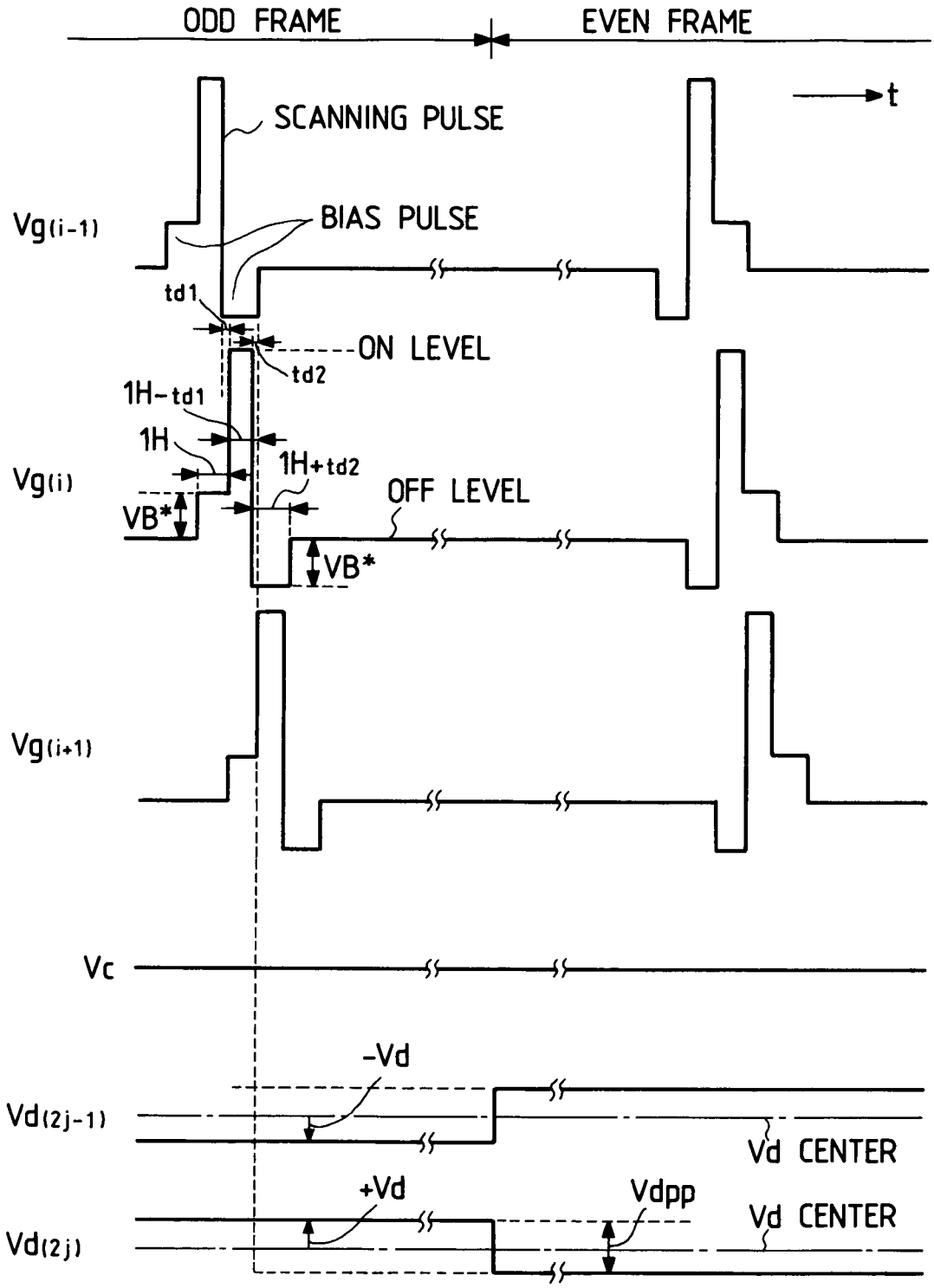
FIG. 16 is a diagram of the driving voltage waveforms in the sixth embodiment.
Figure 27:
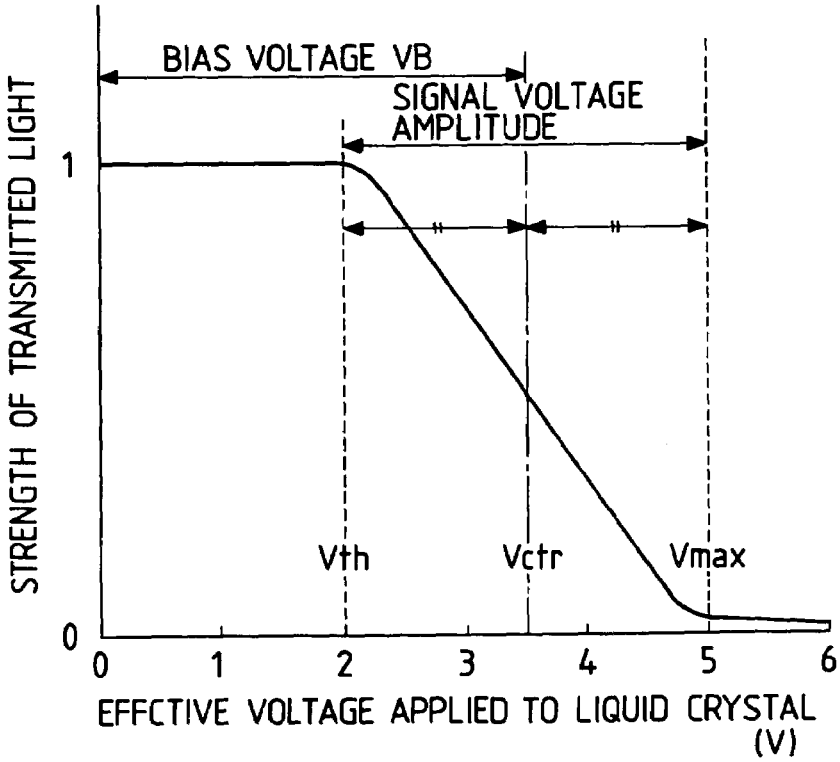
FIG. 27 is a diagram showing the strength of transmitted light with respect to the voltage applied to a liquid crystal.

FIG. 14 shows the circuit constitution of the embodiment and FIG. 15 shows an example in plane views of the structure of the picture element. As shown in FIG. 14, the picture elements between the (i−1)th scanning line and the (i) th scanning line are divided into two groups, that is, an odd column group and an even column group. The gate electrodes of the TFTs of the odd column group are commonly connected to the (i−1)th scanning line and the earth electrodes of the storage capacitances in the same group are commonly connected to the (i)th scanning line. The gate electrodes of the TFTs of the even column group are commonly connected to the (i)th scanning line and the earth electrodes of the storage capacitances in the same group are commonly connected to the (i−1)th scanning line. In this arrangement, (i) is any integer satisfying the condition: $2 \leqq i \leqq M$ (M: a whole number of scanning lines). As far as the connective arrangement of the TFTs to the scanning lines is concerned, the TFTs of the odd column group are connected to the lower side scanning line and the TFTs of the even column group are connected to the upper side scanning line, that is, the TFTs are connected in a zigzag state to a scanning line. The driving LSI 5 for scanning is connected to the scanning lines and the driving LSI 6 of 5 V withstanding voltage for generating the image signal voltages is connected to the signal lines in the display panel having the above-mentioned constitution. FIG. 16 shows waveforms for driving the display panel of this embodiment which are the waveforms of the scanning voltages Vg(i−1),Vg(i) and Vg(i+1) applied to the three adjoining scanning lines, namely, the (i−1)th, the (i)th and the (i+1)th scanning lines, and shows the counter electrode potential Vc, the signal voltage Vd(2*j*−1) applied to the (2*j*−1)th line, namely, the odd column signal line and the signal Vd(2*j*) applied to the (2*j*−1)th line, namely, an even column signal line. The scanning signals Vg applied to each scanning line consist of scanning pulses and bipolar bias pulses of the amplitude VB* superposed before and after the scanning pulse (the positive pulse amplitude may be different from the negative pulse amplitude). Therefore, as the driving LSI for scanning, an LSI which can generate at least four values of voltages is used. Since the liquid crystal must be driven by an alternating current voltage, voltages having a polarity reverse to each other are applied to the liquid crystals in the odd frame and in the even frame, respectively. As shown in FIG. 16, in the odd frame, the waveform superposed by a positive polarity bias pulse of 1H width before 1H of the scanning pulse of the (1H−td1) width and a negative polarity bias pulse of (1H+td2) width right after the scanning pulse is applied; and, in the even frame, the waveform superposed by a negative polarity bias pulse of 1H width before 1H of the scanning pulse of (1H−td1) width and a positive polarity bias pulse of the (1H+td2) width right after the scanning pulse is applied. The rising of the scanning pulse applied to the (i)th scanning line must be done after the scanning pulse applied to the (i−1)th scanning line has dropped sufficiently (the TFT completely turns to the OFF state.) and the necessary dropping time is described by td1. And, application of the scanning pulse to the (i)th scanning line must be done after the scanning pulse of the same scanning line has dropped sufficiently, and the necessary dropping time is described by td2. For example, 3 μs is adopted as the value of td1 and td2. Further, the signal voltage Vd must be changed after the scanning pulse applied to the former scanning line has dropped sufficiently, when signals are written into picture elements selected by the next scanning line, after the writing of image signals into the picture elements selected by a scanning line is finished. The necessary dropping time is assumed to be the same time as td2. The amplitude VB* of the bias pulse is set up as follows, so that the maximum amplitude Vdpp (Vdpp=Vmax−Vth) of the voltage applied to the scanning line becomes minimum, corresponding to the characteristics curve of transmitted light strength-voltage applied to a liquid crystal, as shown in FIG. 27. The voltage actually applied to the liquid crystal is given by the following equation from the bias voltage VB*-applied to the scanning line:

$$VB=(V\max+Vth)/2 \quad (3)$$

where Vth is the optical threshold voltage in the characteristics curve of transmitted light strength-voltage applied to the liquid crystal shown in FIG. 27, and Vmax is the voltage for obtaining a black color display in a normally opened state. Since the counter electrode potential Vc is constant in the embodiment, VB for obtaining the bias voltage VB* is described by the following equation:

$$VB^*=VB(Cs+Clc+Cgs)/Cs \quad (4)$$

where Cgs is the gate-source capacitance of the TFT. For example, if the liquid crystal in which Vth is 2 V is used and Vmax is set, then Vdpp=3 V and VB=3.5 V are obtained. Therefore, in the picture element where Cs=3 Clc is designed, the amplitude VB of the bias voltage is obtained since Cgs<<Cs,Clc. In this case, Vdpp<5 V, and so cheap LSIs of 5 V withstanding voltage can be used, and further more, a contrast ratio of 60 can be obtained. In the waveforms in FIG. 16, in the odd frame, when the scanning pulse is applied to the (i)th scanning line, the positive bias voltage VB* is applied to the (i+1)th line, and a negative bias voltage (−VB*) is applied to the (i−1)th scanning line. And, voltages having a polarity reverse to each other ±Vsig* (=±VB*±Vd: double sign is in the same order.) are written into the storage capacitances of the odd column picture elements and the even column picture elements, respectively, by applying the positive signal voltage (+Vd) to the even column signal lines and the negative signal voltage (−Vd) to the odd column signal lines. In the picture elements selected at the same time, the positive bias voltage and the negative signal voltage are applied to the odd column picture element, and the negative bias voltage and the positive signal voltage are applied to the even column picture elements. Each polarity of the bias voltage and the signal voltage is reverse to each other. And, when the potentials of the (i−1)th, the (i)th, and the (i+1)th scanning lines turn to the OFF level, image signal voltages having a polarity reverse to each other +Vsig(=+VB+Vd: double sign is in the same order.) are applied to the odd column picture elements and the even column picture elements, respectively, and the light transmission rate is controlled thereby. The voltage Vd expresses the potential deviation from the central voltage Vd-center, and its value is 1.5 V in black color displaying and −1.5 V in white color displaying. The polarity of the bias voltages and the signal voltages in the odd frame reverse in the even frame. Since, in the embodiment, the TFTs are arranged in a zigzag state at a scanning line, the sequence means fitted to such TFT arrangement for addressing the image signal data is provided in the image signal generating part. As mentioned above, a good contrast ratio can be obtained, while the voltage amplitudes applied to the signal lines are decreased. Further, by reversing the polarity of the signal voltages written into the picture elements in every column in a frame, the noises induced within the period 1H at the potentials of the counter electrodes and the scanning line through the capacitances between the signal electrodes and the scanning line induced by change of the signal voltage Vd cancel each other between the adjoining picture elements in the horizontal direction. The noises induced within the period 1H at the counter electrodes by the current flowing into the counter electrodes through the liquid crystal capacitances due to the one way nature of the charge current during the image signal writing will also cancel each other between adjoining picture elements. And, as far the effects of the noises induced within the period 1H at the potential of the scanning line by the current flowing into the scanning line through the storage capacitances due to the one way nature of the charge current in the image signal writing is concerned, the ability to absorb noises increases by about two times, and the potential stabilizing time becomes shorter, since the noise effects decrease more rapidly in this embodiment. Thereby, the dependency of the voltages written into the picture elements on the display signal pattern in the horizontal direction is reduced, and consequently, the smearing generated in the horizontal direction is considerably decreased. In the embodiment, a-Si TFTs are used as transistor elements, but the transistor elements are not restricted to any specific type. For example, p-Si TFT or MOS FET devices may be used. Although the picture elements are divided into an odd column group (the first group) and an even column group (the second group) in the embodiment, the dividing is not restricted to any specific arrangement, and only two group dividing is necessary. For example, by bundling the consecutive n columns (n=1, 2, 3, . . . ) in one unit, dividing the units into an odd number unit group and an even number unit group is a useful arrangement. In this way, bias voltages having a polarity reverse to each other through the storage capacitances and signal voltages having a polarity reverse to each other are also applied to the picture elements of the first group and the second group, respectively. And, the bias voltage and the signal voltage applied to the same picture element have a polarity reverse to each other. Such a grouping in which the number of the picture elements in each group is equal makes the noise canceling effect great, and the grouping arrangement in which n=1 makes the effect maximum.

Embodiment 7

The constitution of the embodiment is the same as the embodiment 6 except for the following.

Figure 17:
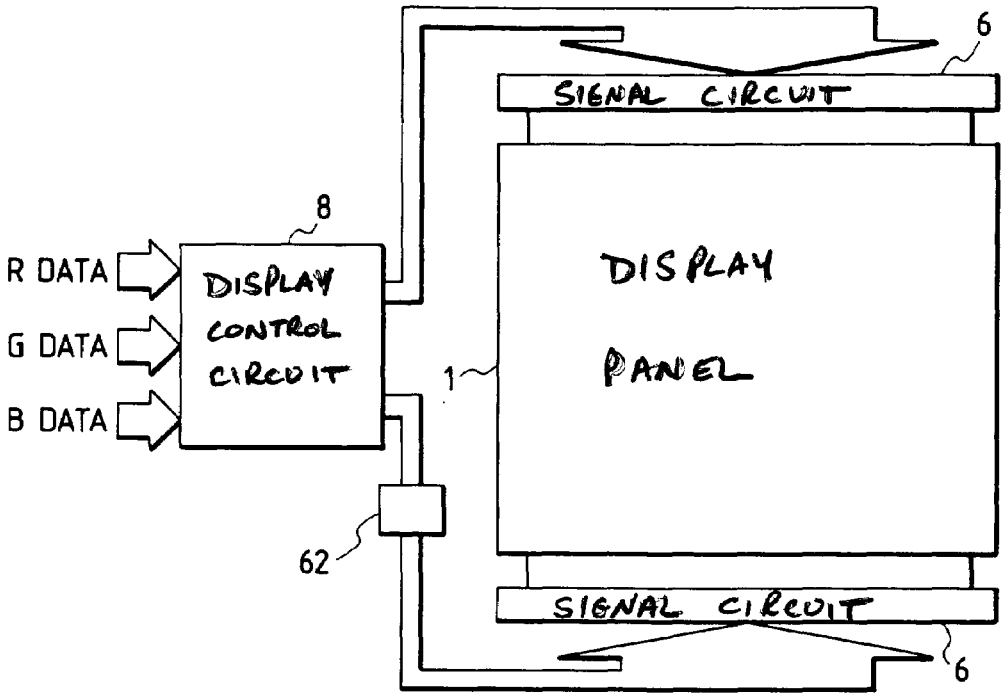
FIG. 17 is a block diagram of the signal voltage generation part in a seventh embodiment.
Figure 18:
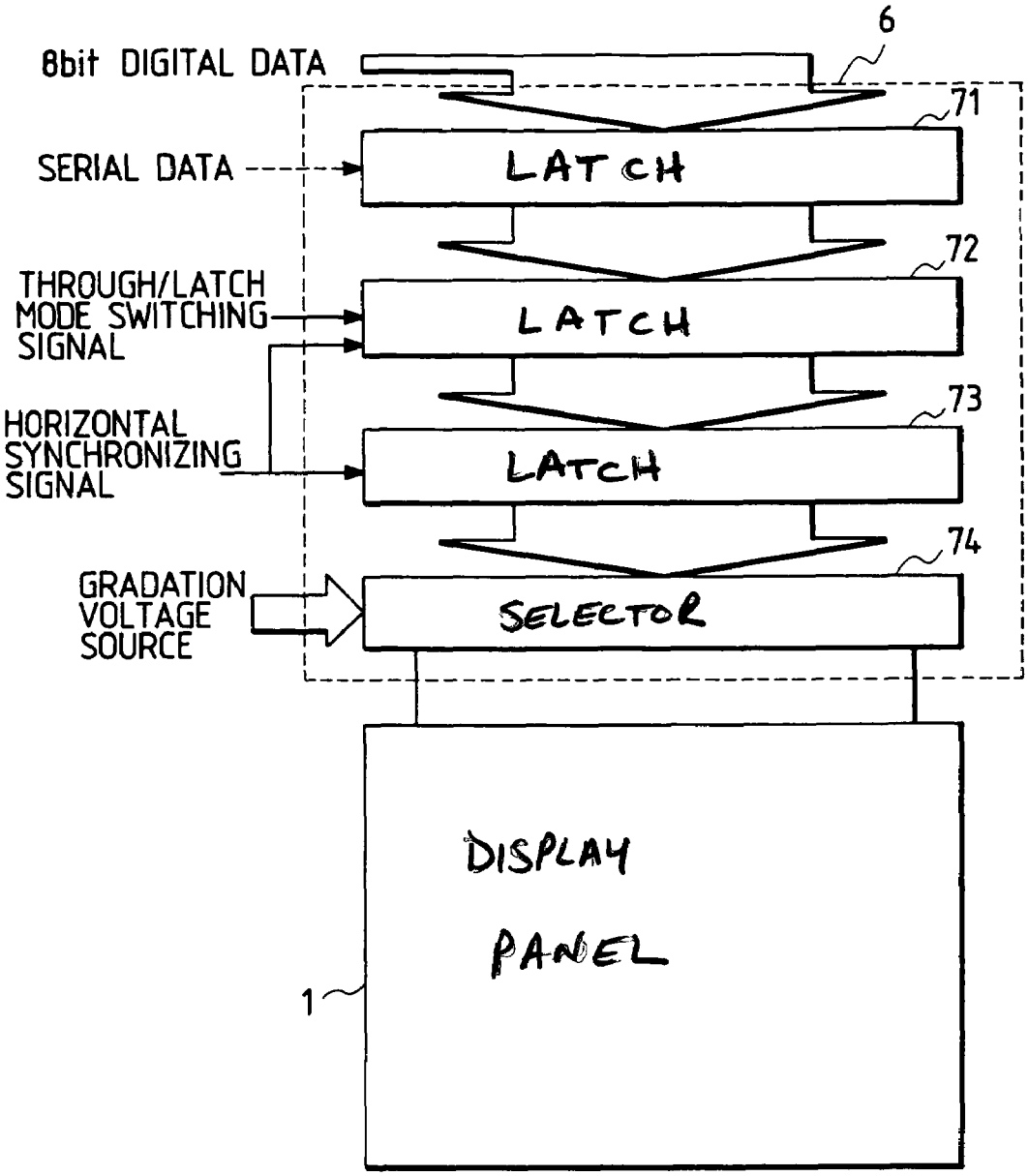
FIG. 18 is a schematic diagram of the signal driving LSI in an eighth embodiment.

In embodiment 6, the TFTs are arranged in a zigzag state at a scanning line and the sequence means fitted to such TFT arrangement for addressing the image signal data is provided in the image signal generating part. But, for making the display apparatus compatible with the signal generating part of a conventional personal computer, it is necessary to delay the odd column image signal data after the even column image signal data by the period 1H in the above-mentioned constitution of the embodiment 6. In the present embodiment, as shown in FIG. 17, the even column image signal data outputted from the controller 8 are held on the bus line for inputting the data to the lower signal driving LSI 6 during the period 1H by using the ½ line memories 62 and inputted to the lower signal driving LSI 6. And, the non-interlaced signals are used as the image signal data. Although ½ line memories are used in the embodiment, the memories 62 may be provided in the controller S. The embodiment has the effects that the display apparatus of the embodiment can be connected to a general purpose image signal generating part of a computer, such as a personal computer, in addition to the effects of the embodiment 6.

Embodiment 8

The constitution of this embodiment is the same as the embodiment 6 except for the following.

For matching the matrix constitution having the TFTs arranged in a zigzag state at a scanning line, a signal driving LSI 6 is used. The signal driving LSI 6 has a shift resistor or a latch 71 for storing the image signals in turn, a latch 73 for storing the image signals Vd fitting the horizontal synchronizing signal, latch 72 capable of selecting a latching or a passing through mode, and a sample hold circuit or a voltage selector 74 for generating the image signal. By setting the latch 72 to the passing through mode in the upper signal driving LSI and to the latching mode in the lower driving LSI, the image signals Vd from the lower driving LSI are delayed by the period 1H. The present embodiment, as well as the embodiment 7, has the effects that the display apparatus of the embodiment can be connected to a general purpose image signal generating part of a computer such as a personal computer, in addition to the effects of the embodiment 6.

Embodiment 9

The constitution of the embodiment is the same as the embodiment 6 except for the following.

Figure 19:
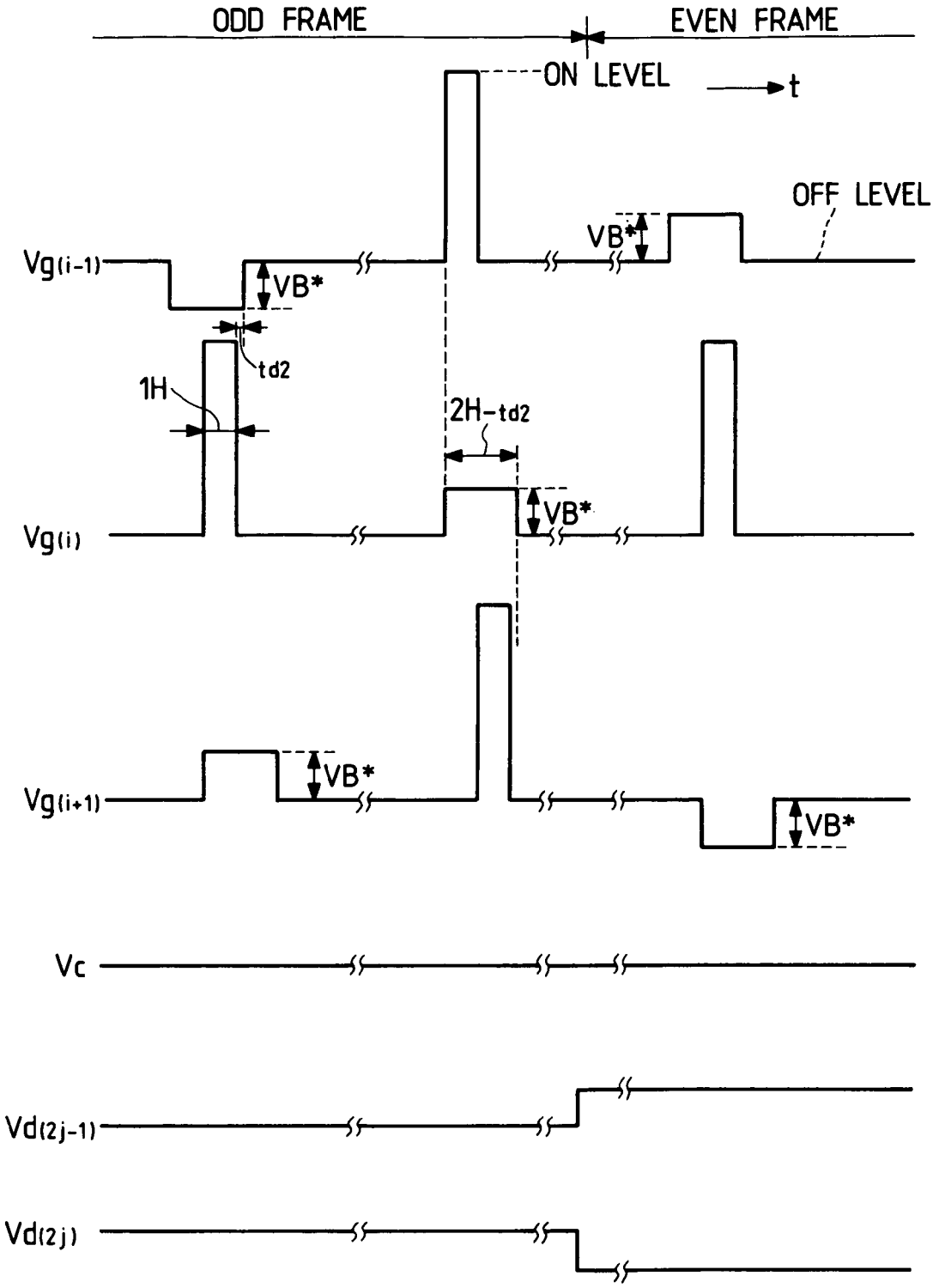
FIG. 19 is a diagram of the driving voltage waveforms in a ninth embodiment.

In FIG. 19, the driving waveforms are shown in the embodiment. The scanning lines are scanned at every two lines (interlaced). Thereby, it is not necessary to wait for the sufficient dropping of the previous scanning pulse for generating the next scanning pulse and the waiting period td1 shown in FIG. 16 is not necessary. And, the capacitances of the liquid crystals and the storage capacitances are charged enough, which prevents a poor charging, since the scanning pulse width can be increased by the period td1 (for example, 3 μs) by the above-mentioned scanning. The image signals of ½ frame in the even column signal lines are stored and outputted to each even column signal line by storing the interlaced signals using ¼ frame memories in the embodiment. The present embodiment, in addition to the effects of the embodiment 6, has the effects that the display apparatus decreases the poor charging and ensures a brightness uniformity.

Embodiment 10

The constitution of the embodiment is the same as the embodiment 6 except for the following.

Figure 20:
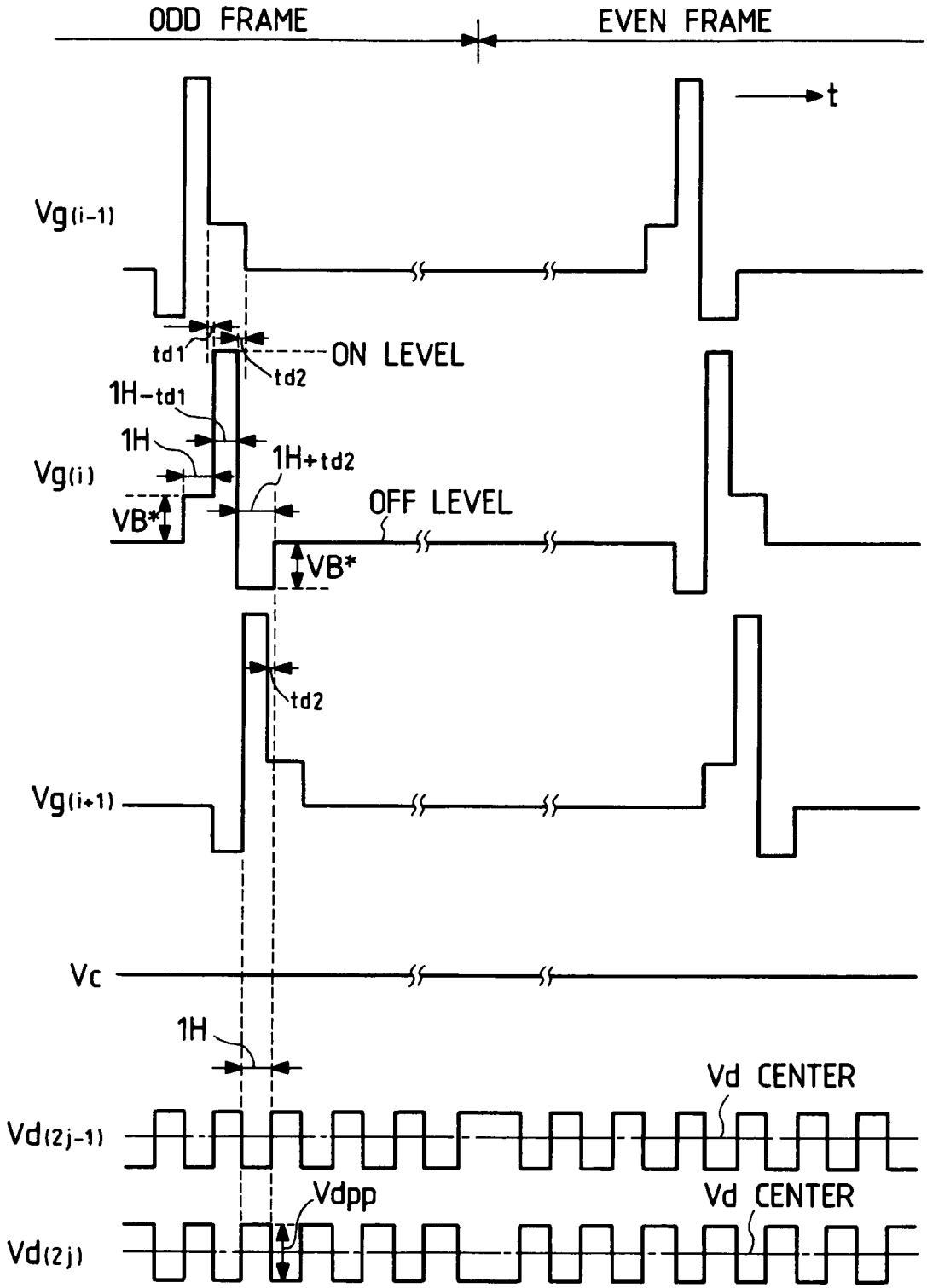
FIG. 20 is a diagram of the driving voltage waveforms in a tenth embodiment.

In the embodiment, the polarity of the signal voltages is reversed at every column and the polarity of the bias pulses is also reversed at every column. The generated waveforms are shown in FIG. 20. By reversed the polarity of the image signal voltages at every column, the noises induced by the signal voltages Vd in one frame at the picture element voltages, through the capacitances between the picture element electrodes and the signal lines, are averaged over the frame, and the vertical smearing depending on the display image pattern in the column direction, in addition to the horizontal smearing, can be also suppressed. The present embodiment, in addition to the effects of the embodiment 6, has the effects that the display apparatus suppresses also any vertical smearing.

Embodiment 11

The constitution of the embodiment is the same as the embodiment 6 except for the following.

Figure 21:
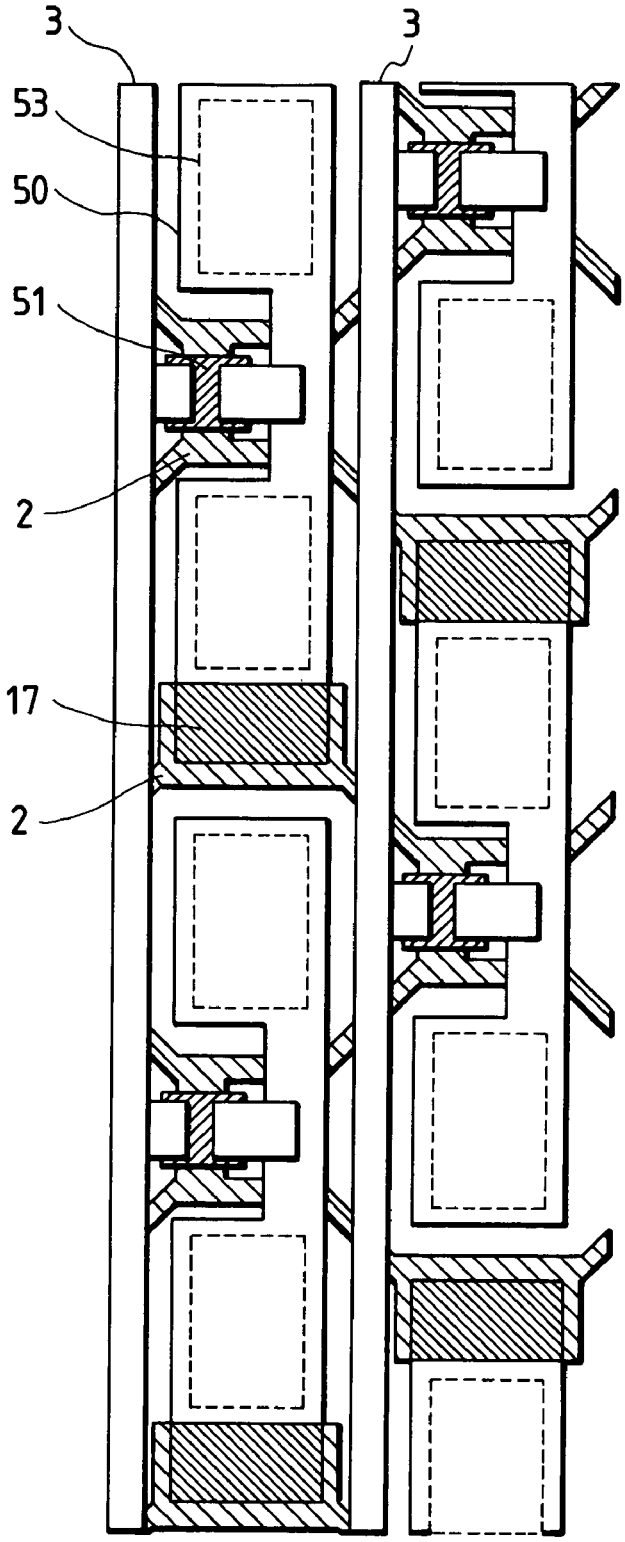
FIG. 21 is a plane view of the structure of a picture element in an eleventh embodiment.

The plane constitution of the picture elements in the embodiment is shown in FIG. 21. The picture element electrode 50, which has two aperture parts, is formed at the both sides of a TFT in the column direction by crossing the TFT. Thereby, the picture elements scanned at the same scanning line are partially overlapped by each other, and, at the same time, the storage capacitances Cs at the odd column and the storage capacitances Cs at the even column are connected to different scanning lines, respectively. The present embodiment has the same electrical circuit arrangement as the embodiment 6, but a spatial constitution different from that of the embodiment 6. The present embodiment can display the display image pattern correctly without shifting each phase of the signal voltages of the odd column and the even column by the period 1H, by remedying spatially the effects by the time lag of the period 1H between the signal voltages of the odd column and the even column. The present embodiment, in addition to the effects of the embodiment 6, has the effects that the display apparatus can present a lower cost module, comprising the controllers and so forth, since the phase shifting of the signal voltages of the odd column and the even column by the period 1H is not needed, and the ½ line memories or the ¼ frame memories do not have to be provided as in the embodiments 7 and 9.

Embodiment 12

Figure 22:
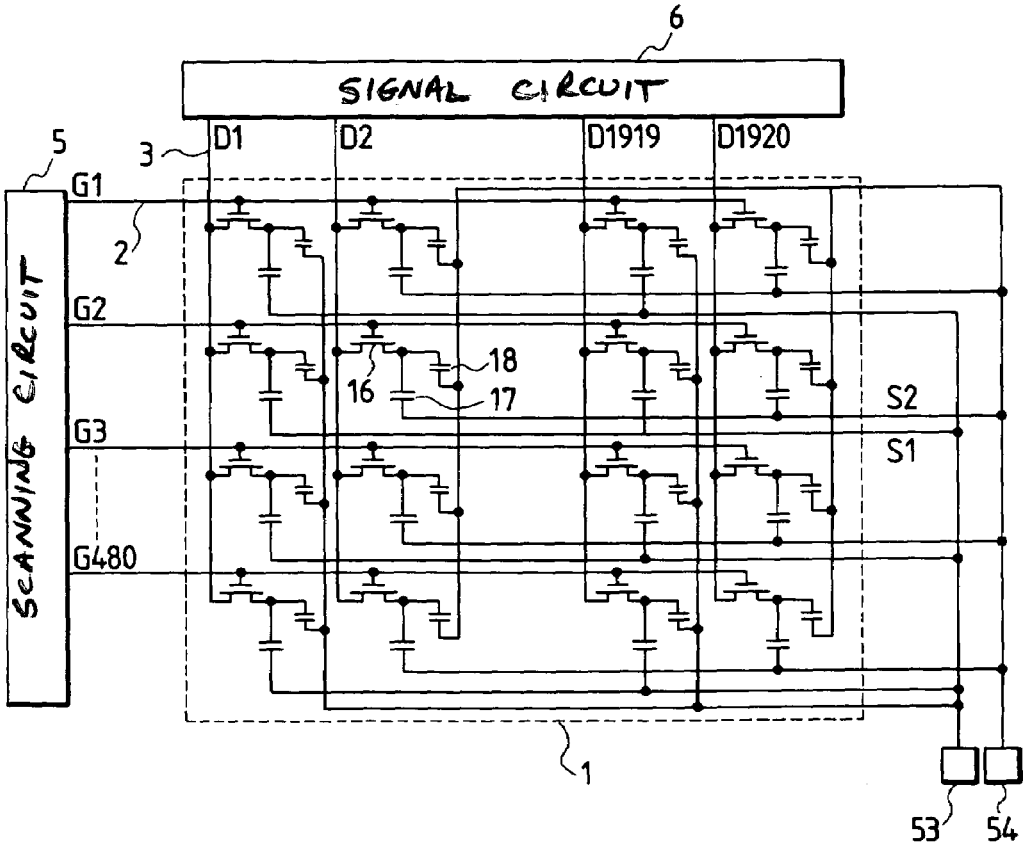
FIG. 22 is a schematic circuit diagram of a twelfth embodiment.
Figure 23:
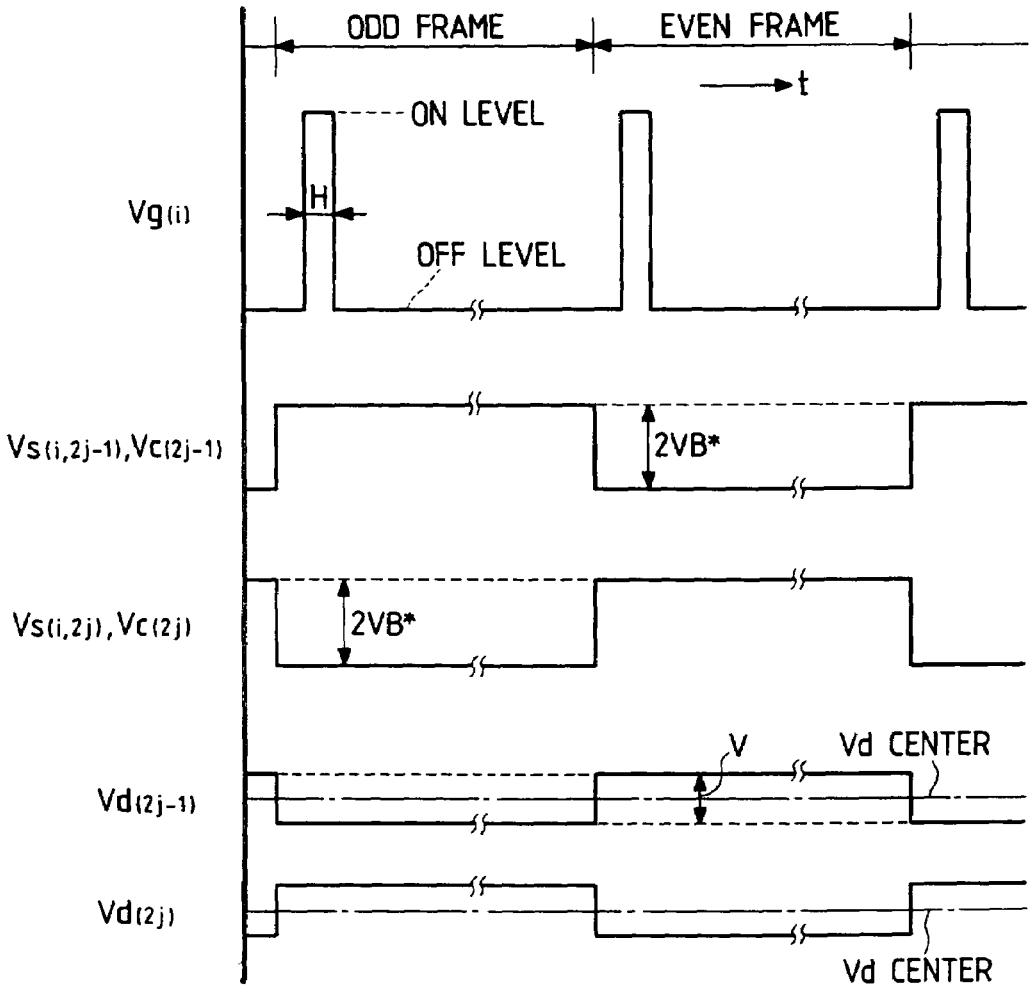
FIG. 23 is a diagram of the driving voltage waveforms in the twelfth embodiment.

The circuit diagram of the active matrix liquid crystal display apparatus of the embodiment is shown in FIG. 22. By forming the counter electrodes in a stripe state and grouping them into odd column electrodes and even column electrodes, each group is commonly connected to the first bias circuit 53 and the second bias circuit 54, respectively. And, the storage capacitances Cs are formed by the gate insulating film sandwiched between the wiring (storage wiring) constituted by the same material and layer as the scanning wiring and the picture elements, and the odd column storage capacitances are commonly connected to the storage lines S1 and the even column storage capacitances are commonly connected to the storage lines S2. All the storage lines S1 are connected together and to the first bias circuit 53, and all the storage lines S2 are connected together and to the second bias circuit 54. Although the picture elements at the same line are divided into an odd column group (the first group) and the even column group (the second group) in the embodiment, the manner in which the columns are divided is not restricted to any specific way, and only a two group dividing of the picture elements selected at the same time and on the same scanning line is necessary. Particularly, if the column picture elements are divided two groups in every column, as in this embodiment, the flickering is most effectively suppressed due to a short reversing period of the polarity. However, the column grouping in every column brings about a high probability of short-circuits, so it is preferable to determine the number of the grouping of the columns by considering the trade-off between the suppression of flickering and the reduction in short circuit occurrences. In FIG. 23, the driving waveforms are shown. The rectangular waveform voltages Vs and Vc having the amplitude 2 VB* outputted from the first and the second bias circuit are applied to the storage lines and the counter electrodes in alternating periods at two frames. The phase shift between the voltage waveforms outputted from the first bias circuit 53 and the second bias circuit 54 is 180 degrees (each polarity of the voltages is reverse to each other) and the voltages of the polarity reverse to each other are superposed on the signal voltages of the odd column and the even column picture elements, respectively. Since the liquid crystal needs to be driven by an alternating current voltage, voltages having a polarity reverse to each other are superposed on the liquid crystals in the odd frame and in the even frame, respectively. The polarity reversing is done during the period of a retrace line. And, the signal voltages outputted to the odd column and the even column signal lines have polarity reverse to each other and are changed in every frame. The bias pulse amplitude 2 VB* is set according to the characteristics curve of transmitted light strength-applied voltage so that the bias voltage VB is within the range Vth≦VB≦Vmax and the maximum amplitude Vdpp of the voltages applied to the signal lines is the minimum value (Vdpp=Vmax−Vth). First, the amplitude 2 VB is determined by Eq. (3) similarly in the embodiment 6. Let Cgs<<Cs,Clc (Cgs: capacitance between TFTs, Cs: storage capacitance, Clc: liquid crystal capacitance), and the bias voltage VB(=VB*) is given by the bias pulse amplitude 2 VB* as the voltage applied to the liquid crystal. For example, by using a liquid crystal in which Vth is 2 V and setting Vmax=5 V, Vdpp=3 V and VB=3.5 V are obtained. And, the bias pulse amplitude 2 VB* is set to 7 V. For turning over the polarity of the odd column signal voltage and the polarity of the even column signal voltage in every column, respectively, it is possible that, by dividing the signal driving LSI into an upper one and a lower one and by connecting the odd column signal lines to the upper signal driving LSI and the even column signal lines to the lower signal driving LSI, the voltages outputted from the upper signal driving LSI and the lower signal driving LSI have polarity reverse to each other. By controlling the polarity of the image signal voltages so that the voltages +Vsig(=VB+Vd, double sign is in the same order) are applied as the image signal voltage, the polarity of the image signal voltages is reversed in every column, where Vd is the potential difference from the center voltage Vd-center, and its value is 1.5 V in black color displaying and −1.5 V in white color displaying. And, by this embodiment, the contrast ratio of 60 is gained; and, further, LSIs of 5 V withstanding voltage can be used, since Vdpp=3 V and the cost spent for LSIs can be also reduced.

Embodiment 13

Figure 24:
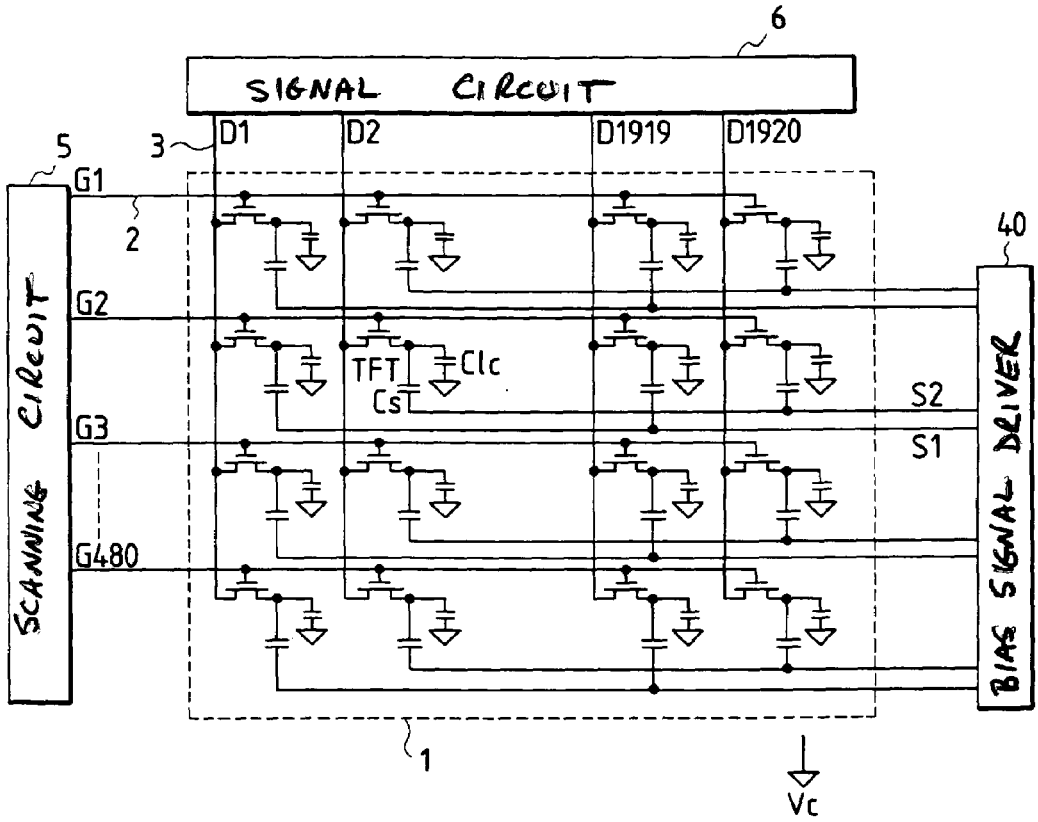
FIG. 24 is a schematic the circuit diagram of a thirteenth embodiment.
Figure 25:
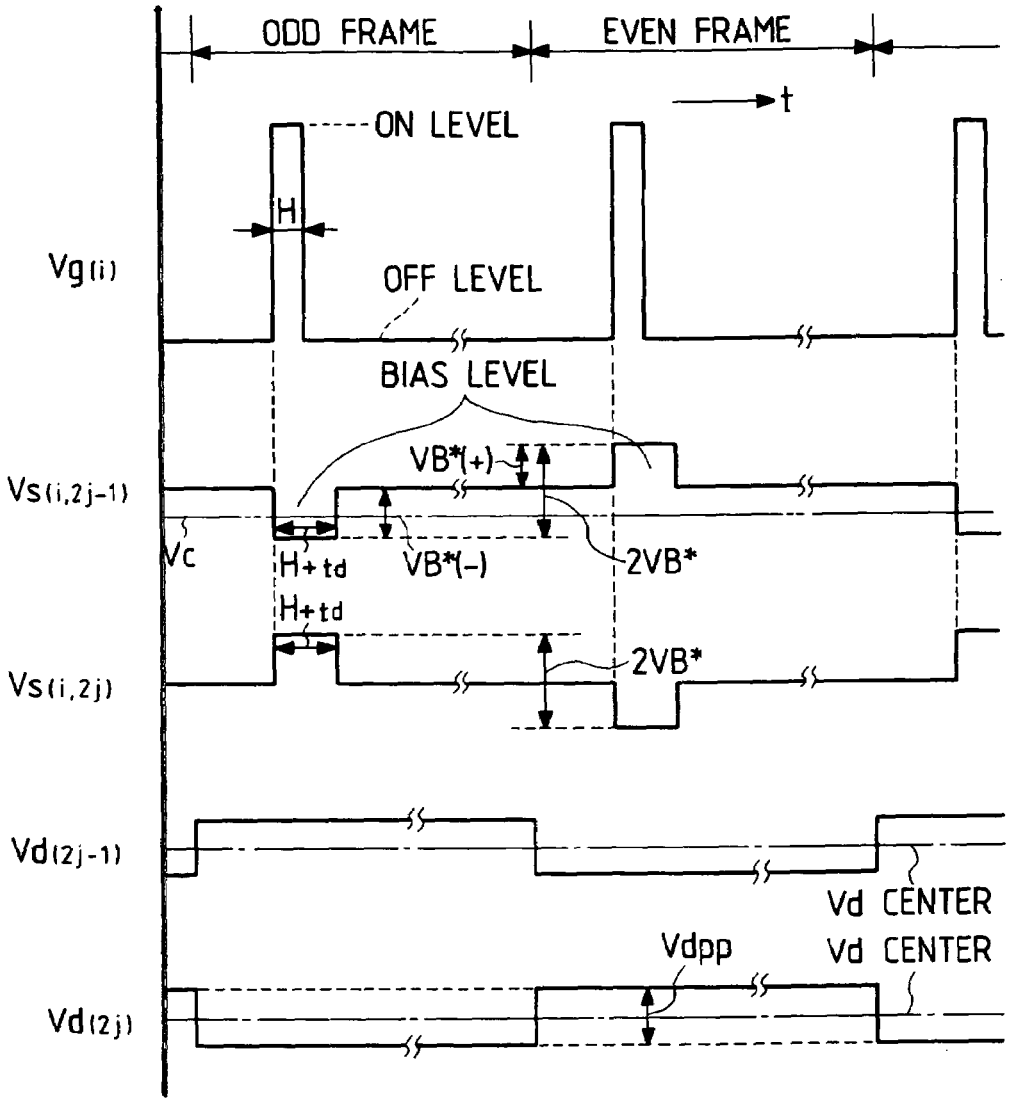
FIG. 25 is a diagram of the driving voltage waveforms in a thirteenth embodiment.

The circuit diagram of the active matrix liquid crystal display apparatus of this embodiment is shown in FIG. 24. The counter electrode is formed all over the picture elements. The storage capacitances Cs are formed by the storage lines, the picture element electrodes and the gate insulating film between them, and the odd column picture elements are connected to the storage lines S1 and the even column picture elements to the storage lines S2. The storage lines S1 and S2 are respectively connected to the bias signal driving LSI 40 in every column thereof and is insulated electrically. FIG. 25 shows the driving waveforms of the embodiment. The bias pulses from the bias signal driving LSI 40 are applied to each of the storage lines when the line is selected. So, since voltages having a polarity reverse to each other are superposed on the picture elements of the odd column and the even column, respectively, the polarity of the bias pulses applied to the storage lines S2 is made reverse to the polarity of the bias pulses of the storage lines S2. And, bias voltages having a polarity reverse to each other are applied to the liquid crystals in the odd frame and in the even frame, respectively, since the liquid crystal needs to be driven by an alternating current voltage. Since the counter electrode is connected in common to all of the picture elements in this embodiment, the counter electrode potential is set constant and two voltages of different polarity are supplied as the bias voltage only through the storage capacitances. The bias pulse amplitudes VB*(+) and VB*(−) are set as follows. First, the bias voltages applied to the liquid crystals are set by Eq. (3) similarly to the embodiment 6. And, letting VB*(+)+VB*(−)=2VB*, particularly VB(+)*=VB*(−)=VB*, the relation between VB and VB is given by Eq. (4). For example, by using the liquid crystal in which Vth is 2 V, VB=3.5 V is obtained. And, by using a picture element in which Cs equals 3 Clc, VB* is set to 4.7 V for setting to VB* 3.5 V, since Cgs<<Cs,Clc. By controlling the polarity of the image signal voltages so that the voltages +Vsig (=VB±Vd, double sign is in the same order) are applied as the image signal voltages, the polarity of the image signal voltages is also reversed in every column in the present embodiment, similar to the embodiment 12. And, the bias pulses must be dropped after the TFTs coupled the lines to which the pulses are applied completely turn to the OFF state. The maximum delay time td is, for example, 3 μs and the bias pulse width is set to (1H+td). And, by this embodiment, a contrast ratio of 60 is obtained, and, further, LSIs of 5 V withstanding voltage can be used since Vdpp<5 V. Further, by the constitution of the present embodiment, the product process for dividing the counter electrodes is not needed, so the panel product cost can be reduced by a throughput improvement, a decrease of material cost in the use of resist material can be obtained, and yield rate improvement can be experienced.

Embodiment 14

Figure 26:
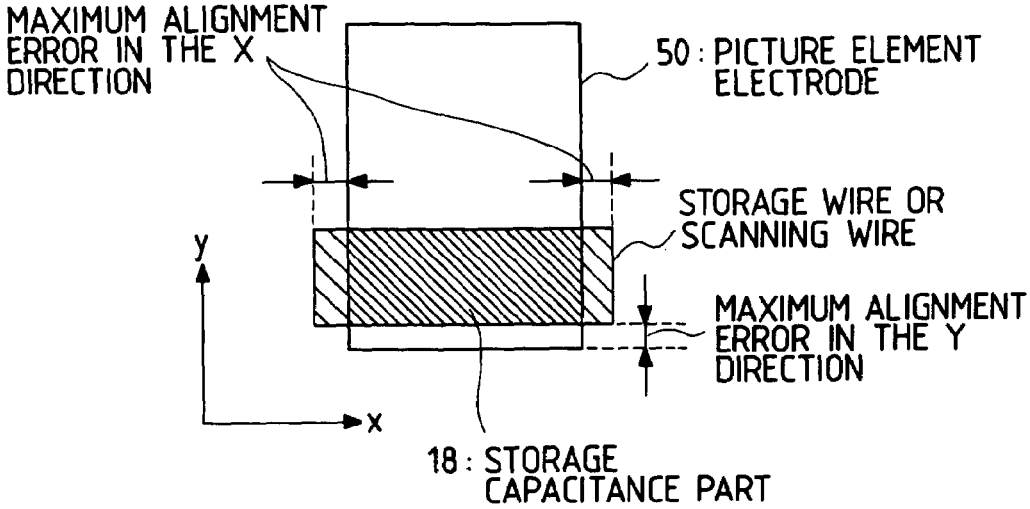
FIG. 26 is a diagram of a storage capacitance part in a fourteenth embodiment.

The constitution of the embodiment is the same as the embodiment 13 except for the following. FIG. 26 shows the plane pattern of the storage capacitance part in the embodiment. The storage capacitance is formed by the scanning line or the storage line in the same layer as the scanning line, a part of the picture element and the gate insulating film. Since the scanning line and the picture element electrode lie in different layers, the storage capacitance depends on places of the panel due to the inaccuracy of photo-mask alignment, which changes the bias voltage. The bias voltage variation induces the brightness non-uniformity in the block state. By this embodiment, as shown in FIG. 26, a plane pattern is presented as the intersecting area of the picture element electrode, and the storage line in the same layer as the scanning line does not change even if the photo-mask shifts before and behind, and left and right.

The present embodiment, in addition to the effects of the embodiment 6, has the effects that the display apparatus can present a picture without block non-uniformity.

What is claimed is:

1. A matrix panel display apparatus comprising:

plural signal lines and plural scanning lines intersecting each other and, near each intersection point, a picture element including a picture element electrode, a counter electrode, a display medium disposed between said picture element electrode and said counter electrode, and a transistor for applying image signals from said signal line to said picture element electrode, said transistor being controlled in response to scanning signals received on a scanning line;

a plurality of storage capacitances, each connected to a respective one of said picture elements;

picture signal generating means in a signal circuit for dividing plural picture elements selected at the same time into two groups and for applying a first picture signal group to a first group of picture elements and a second picture signal group, having a polarity reverse to the first picture signal group, to a second group of picture elements;

bias signal generating means for applying a first bias signal group, having a polarity reverse to said first picture signal group, to said first group of picture elements through storage capacitances in said first group of picture elements and for applying a second bias signal group, having the polarity reverse to said second picture signal group, to said second group of picture elements through storage capacitances in said second group of picture elements, during a selection period of said first and second groups of picture elements;

wherein a control terminal of each transistor is connected to a scanning line, a main terminal thereof to a signal line, and the other main terminal thereof to one of the terminals of said picture element electrode and said storage capacitance; and wherein two groups of said bias signals, having a polarity reverse to each of said two image signal groups, are applied to said storage capacitances in each of said picture element groups, respectively; and wherein said bias signal generating circuit includes a scanning signal generating circuit for applying a scanning voltage to said picture element through said scanning lines.

2. A matrix panel display apparatus comprising:

plural signal lines and plural scanning lines intersecting each other and, near each intersection point, a picture element including a picture element electrode, a counter electrode, a display medium disposed between said picture element electrode and said counter electrode, and a transistor for applying image signals from said signal line to said picture element electrode, said transistor being controlled in response to scanning signals received on a scanning line;

a plurality of storage capacitances, each connected to a respective one of said picture elements;

picture signal generating means in a signal circuit for dividing plural picture elements selected at the same time into two groups and for applying a first picture signal group to a first group of picture elements and a second picture signal group, having a polarity reverse to the first picture signal group, to a second group of picture elements;

bias signal generating means for applying a first bias signal group, having a polarity reverse to said first picture signal group, to said first group of picture elements through storage capacitances in said first group of picture elements and for applying a second bias signal group, having the polarity reverse to said second picture signal group, to said second group of picture elements through storage capacitances in said second group of picture elements, during a selection period of said first and second groups of picture elements;

wherein a terminal of a storage capacitance belonging to said first group of picture elements is connected to a scanning line which is located one line before a line being scanned presently;

wherein a terminal of a storage capacitance belonging to said second group of picture elements is connected to a scanning line which is located one line behind a line being scanned presently;

wherein said bias signal generating means operates to apply a first bias signal to a scanning line which is located one line before a line being scanned presently and to apply a second bias signal of the polarity reverse to said first bias signal to a scanning line which is located one line behind a line being scanned presently, while one scanning line is selected; and wherein said apparatus further comprises an image signal generating circuit which applies image signals having a polarity reverse to said first bias signal to said first group of picture elements and image signals having the polarity reverse to said second bias signal to said second group of picture elements.

3. A matrix panel display apparatus according to claim 1 or 2, wherein said display medium is a liquid crystal.

4. A matrix panel display apparatus according to claim 1 or 2, wherein in each of said first image signal group and said second image signal group, the polarity of said image signals are reversed in successive frames.

5. A matrix panel display apparatus according to claim 1 or 2, wherein the number of said first group of picture elements nearly equals the number of said second group of picture elements.

6. A matrix panel display apparatus according to claim 1 or 2, wherein each picture element group consisting of the picture elements of every n column elements ($n \geqq 1$) is alternately assigned to said first group of picture elements and said second group of picture elements, respectively.

7. A matrix panel display apparatus according to claim 2, wherein a control terminal of each transistor is connected to a scanning line, a main terminal thereof to a signal line, and the other main terminal thereof to one of the terminals of said picture element electrode and said storage capacitance; and wherein two groups of said bias signals, having a polarity reverse to each of said two image signal groups, are applied to said storage capacitances in each of said picture element groups, respectively.

8. A matrix panel display apparatus according to claim 2, wherein each picture element group consisting of picture elements of every n column elements ($n \geqq 1$) is alternately assigned to said first group of picture elements and said second group of picture elements, respectively.

9. A matrix panel display apparatus according to claim 2, wherein said scanning signal generating circuit generates bias voltages such that, when a scanning pulse is applied to said scanning line, each polarity of said first bias signal and said second bias signal applied to said scanning line is constant independently of said scanned line in one frame period.

10. A matrix panel display apparatus according to claim 2, further comprising a scanning signal generating circuit which generates bias voltages such that, when a scanning pulse is applied to said scanning line, the polarity of said first bias signal group and said second bias signal group applied to said scanning line is alternately reversed as said scanning pulse transfers in turn on said scanning lines;

wherein said image signal generating circuit generates image signals so that the polarity of said first image signal and said second image signal is alternately reversed in every scanning period as said scanning pulse transfers in turn on said scanning lines.

11. A matrix panel display apparatus according to claim 2, wherein said image signal generating circuit includes:

a first image signal generating part for applying image signals to a first group of picture elements; and a second image signal generating part for applying image signals to a second group of picture elements.

12. A matrix panel display apparatus according to claim 2, wherein said image signal generating circuit includes:

a first latch for storing image signals in turn;

a second latch for storing image signals which are synchronized with a horizontal synchronizing signal;

a third latch capable of either latching said image signals or passing said image signals; and a sample hold circuit for generating said image signals.

13. A matrix panel display apparatus according to claim 2, wherein said scanning circuit executes interlaced scanning.

14. A matrix panel display apparatus according to claim 2, wherein each electrode of said first group of picture elements partially overlaps with each electrode of said second group of picture elements in the column direction.

15. A matrix panel display apparatus according to claim 2, wherein said first group of picture elements consists of odd column picture elements and said second group of picture elements consists of even column picture elements.

16. A computer system comprising a matrix panel display apparatus according to claim 2.

* * * * *